US006022212A

United States Patent [19]

Saito et al.

[11] Patent Number: 6,022,212

[45] **Date of Patent: *Feb. 8, 2000**

[54] SAFETY DEVICE IN LIGHTING RODS

[76] Inventors: Masaki Saito; Toshihiro Ichikawa, both of c/o Tokai Corporation, 3-4 Shimohara, Subashiri, Oyama-cho, Sunto-gun, Shizuoka-ken, Japan

[ * ] Notice: This patent is subject to a terminal disclaimer.

[21] Appl. No.: 09/186,952

[22] Filed: Nov. 5, 1998

Related U.S. Application Data

[60] Division of application No. 08/986,081, Dec. 5, 1997, which is a continuation-in-part of application No. 08/515,510, Aug. 15, 1995, Pat. No. 5,697,775.

[30] Foreign Application Priority Data

| | | | |
|---|---|---|---|
| Aug. 18, 1994 | [JP] | Japan | 6-193953 |
| Aug. 30, 1994 | [JP] | Japan | 6-205388 |
| Oct. 12, 1994 | [JP] | Japan | 6-246205 |
| Oct. 12, 1994 | [JP] | Japan | 6-246206 |
| Oct. 17, 1997 | [JP] | Japan | 9-284789 |

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 5,326,256 | 7/1994 | Shike et al. | 431/255 |
| 5,697,775 | 12/1997 | Saito et al. | 431/153 |
| 5,897,308 | 4/1999 | Saito et al. | 431/153 |

*Primary Examiner*—Carroll Dority
*Attorney, Agent, or Firm*—Baker & Botts, LLP

[57] ABSTRACT

A safety device in a lighting rod comprises a locking member having an engagement section, which interferes with a portion of an operation member and thereby locks the lighting operation of the operation member. The locking member can move in a direction, that intersects with the direction along which the operation member moves. An urging member urges the locking member to a locking direction. The locking member is provided with a lock releasing section, which can be operated in order to move the locking member in a direction, that acts against the urging force of the urging member. The lock releasing section is projected to a position, which stands facing the operating section of the operation member. The lock of the lighting operation is released by operating the lock releasing section of the locking member, and the lighting operation is carried out in this state by operating the operating section of the operation member. The locking member automatically returns to the state of the locking as the operation member returns to its original position.

6 Claims, 24 Drawing Sheets

101

101

SAFETY DEVICE IN LIGHTING RODS

REFERENCE TO RELATED APPLICATIONS

This application is a division of application Ser. No. 08/986,081 filed Dec. 5, 1997 which is a continuation-in-part of application Ser. No. 08/515,510 filed Aug. 15, 1995, now U.S. Pat. No. 5,697,775.

BACKGROUND OF THE INVENTION

1. Field of the Invention

This invention relates to a safety device in a lighting rod, in which a flame is produced and jetted from a rod-like top end portion by a lighting operation of an operation member, wherein the lighting operation of the operation member is locked when the lighting rod is not used, and wherein the lock is released and the lighting operation is enabled when the lighting rod is used.

2. Description of the Prior Art

Lighting rods are useful apparatuses, which can light a fire easily when trigger-like operation members are pushed down. However, with the lighting rods, persons, such as children, who do not know how to use the lighting rods appropriately, can light a fire carelessly. Therefore, the lighting rods are not favorable from the viewpoint of safety.

Accordingly, a need exists for a lighting rod having enhanced safety characteristics such that persons, who do not know how to use the lighting rod appropriately, cannot light a fire carelessly, or such that accidental lighting may not occur. To satisfy such a need, lighting rods provided with various safety devices have been proposed.

For example, in Japanese Unexamined Utility Model Publication No. 62(1987)-5565, Japanese Patent Publication No. 60(1985)-122828, and U.S. Pat. No. 5,199,865, safety devices in lighting rods have been proposed, wherein a locking member for obstructing the driving operation of an operation member is manually moved between a position for the locking and a position for the lock release. With the proposed safety devices, after the locking member has been moved from the position for the locking to the position for the lock release and a fire has been lighted, if the locking member is not returned manually to the position for the locking, the safety device is kept in the state in which the lock is released.

With the conventional lighting rods described above, the problems occur in that, after the locking member has been moved to the position for the lock release and a fire has been lighted, if the user forgets to return the locking member from the position for the lock release to the position for the locking, and the locking member is thus left to stand at the position for the lock release, the locking member does not execute the locking function as the safety device, and therefore the careless lighting described above will occur.

Also, for example, in U.S. Pat. Nos. 4,832,596; 5,240,408 and 5,368,473 structures for gas lighters have been proposed, wherein a locking member, which can be deformed or can slide, is located at a portion of an actuation lever, which is pushed down when a fire is to be lighted. The locking member disables the actuation lever from operating. When the locking member is manually operated to a position for the lock release and the actuation lever is thereafter pushed down, the lock member moves to a position capable of locking in accordance with the operation for pushing the actuation lever down. Alternatively, when a finger of the user is moved away from the gas lighter, the locking member returns to the state of the locking by the force of a spring. In this manner, with the proposed structures for gas lighters, the locking member is not left to stand in the state of the lock release.

However, the aforesaid safety mechanisms for gas lighters cannot be directly applied to a lighting rod, which has a different structure. Therefore, a need exists for a mechanism suitable for the lighting rod to be achieved with a simple structure in relation to the structure a main body of a lighting rod, the shape of an operation member for carrying out the operation for the lighting, a protection frame formed around the operation member, and the like, such that a lighting operation may be locked when the lighting rod is not used, such that the lock of the lighting operation may be released by an operation independent from the operation member and the lighting may thereby be enabled when a fire is to be lighted, and such that, after the lighting, the state of the locking may be restored automatically, accompanying a returning movement of the operation member.

SUMMARY OF THE INVENTION

The primary object of the present invention is to provide a safety device, which is applied to a lighting rod for carrying out the lighting by an operation of an operation member, and which enables the locking of a lighting operation, the release of the lock, and automatic return to the state of the locking.

Another object of the present invention is to provide a safety device in a lighting rod, wherein it is difficult for persons, who do not know how to use the lighting rod appropriately, to release the lock, and careless lighting is thereby prevented.

The present invention provides a first safety device in a lighting rod, which lighting rod is provided with a rod-like top end portion and a main body, the rod-like top end portion being provided with a jetting nozzle for jetting out a gas, the main body being provided with:

i) a gas tank, ii) a valve mechanism for opening and closing a path, through which the gas is supplied from the gas tank to the jetting nozzle, iii) a piezo-electric unit for generating a discharge voltage for lighting the gas, and iv) an operation member, which is capable of sliding, which has an operating section, and which drives the valve mechanism and the piezo-electric unit in order to carry out a lighting operation, the operating section of the operation member being exposed to the exterior of the main body, the safety device comprising:

a) a locking member having an engagement section, which interferes with a portion of the operation member and thereby locks the lighting operation of the operation member, the locking member being capable of moving in a direction, that intersects with the direction along which the operation member moves, and b) an urging member, which urges the locking member to a locking direction, the locking member being provided with a lock releasing section, which is capable of being operated in order to move the locking member in a direction, that acts against the urging force of the urging member, the lock releasing section being projected to a position, which stands facing the operating section of the operation member, wherein the lock of the lighting operation is released by operating the lock releasing section of the locking member, the lighting operation is carried out in this state by operating the operating section of the operation member, and the locking member automatically returns to the state of the locking as the operation member returns to its original position.

The first safety device in a lighting rod in accordance with the present invention should preferably be constituted such that the locking member may have an approximately U-shaped form, one end portion of the locking member may constitute the engagement section, the other end portion of the locking member may constitute the lock releasing section, and the engagement section may engage with an engagement hole of the operation member and may thereby lock the operation member such that the operation member cannot move.

The present invention also provides a second safety device in a lighting rod, which lighting rod is provided with a rod-like top end portion and a main body, the rod-like top end portion being provided with a jetting nozzle for jetting out a gas, the main body being provided with:

i) a gas tank, ii) a valve mechanism for opening and closing a path, through which the gas is supplied from the gas tank to the jetting nozzle, iii) a piezo-electric unit for generating a discharge voltage for lighting the gas, and iv) an operation member, which is capable of sliding, which has an operating section, and which drives the valve mechanism and the piezo-electric unit in order to carry out a lighting operation, the operating section of the operation member being exposed to the exterior of the main body, the safety device comprising:

a) a locking member, which interferes with the operation member and thereby locks the lighting operation of the operation member, the locking member being capable of moving in a direction, that intersects with the direction along which the operation member moves, and b) an urging member, which urges the locking member to a locking direction, the locking member being provided with a lock releasing section, which is capable of being operated in order to move the locking member in a direction, that acts against the urging force of the urging member, the lock releasing section being projected to the exterior of the main body on the side opposite to the operation member, wherein the lock of the lighting operation is released by operating the lock releasing section of the locking member, the lighting operation is carried out in this state by operating the operating section of the operation member, and the locking member automatically returns to the state of the locking as the operation member returns to its original position.

The second safety device in a lighting rod in accordance with the present invention should preferably be constituted such that the locking member may comprise:

1) a bar-like shaft, which is inserted transversely through the main body, 2) an engagement section, which is located at one end of the bar-like shaft, the engagement section being inserted into an engagement groove of the operation member, interfering with the operation member, and thereby locking the operation member such that the operation member cannot move, 3) the lock releasing section, which is used for a pushing operation and is located at the other end of the bar-like shaft, and 4) an urging member receiver, which receives one end of the urging member, whereby, when the pushing operation of the lock releasing section is carried out, the engagement section moves inwardly into the operation member and enables the operation member to move for the lighting.

The present invention further provides a third safety device in a lighting rod, which lighting rod is provided with a rod-like top end portion and a main body, the rod-like top end portion being provided with a jetting nozzle for jetting out a gas, the main body being provided with:

i) a gas tank, ii) a valve mechanism for opening and closing a path, through which the gas is supplied from the gas tank to the jetting nozzle, iii) a piezo-electric unit for generating a discharge voltage for lighting the gas, iv) an operation member, which is capable of sliding, which has an operating section, and which drives the valve mechanism and the piezo-electric unit in order to carry out a lighting operation, the operating section of the operation member being exposed to the exterior of the main body, and v) a guide frame, which is located so as to surround the operating section of the operation member, the safety device comprising:

a) a locking member, which interferes with the operation member and thereby locks the lighting operation of the operation member, the locking member being associated with the guide frame such that the locking member can rotate, and b) an urging member, which urges the locking member to a locking direction, the locking member projecting to the side outward from the guide frame when the locking member is in the state of the locking, the locking member being provided with a lock releasing section, which is capable of being operated in order to move the locking member in a direction, that acts against the urging force of the urging member, and in order to thereby release the interference of the locking member with the operation member, wherein the lock of the lighting operation is released by operating the lock releasing section of the locking member, the lighting operation is carried out in this state by operating the operating section of the operation member, and the locking member automatically returns to the state of the locking when the operation member returns to its original position in the state in which the lock releasing operation has been released.

The third safety device in a lighting rod in accordance with the present invention should preferably be constituted such that the locking member may be provided with a projection, which interferes with a portion of the operation member when the locking member is located at the position for the locking, and such that the operation member may be provided with a groove, through which the projection of the locking member is inserted when the locking member has been rotated to the position for the lock release.

Also, the groove of the operation member should preferably be provided with an engagement section, which comes into contact with the projection of the locking member and restricts the rotation of the locking member to the state of the locking when the projection of the locking member is being inserted through the groove of the operation member.

The present invention still further provides a fourth safety device in a lighting rod, which lighting rod is provided with a rod-like top end portion and a main body, the rod-like top end portion being provided with a jetting nozzle for jetting out a gas, the main body being provided with:

i) a gas tank, ii) a valve mechanism for opening and closing a path, through which the gas is supplied from the gas tank to the jetting nozzle, iii) a piezo-electric unit for generating a discharge voltage for lighting the gas, iv) an operation member, which is capable of sliding, which has an operating section, and which drives the valve mechanism and the piezo-electric unit in order to carry out a lighting operation, the operating section of the operation member being exposed to the exterior of the main body, and v) a protection frame, which is located so as to surround the operating section of the operation member, the safety device comprising a locking means, which is constituted of the protection frame of the main body of the lighting rod, the protection frame having one end, which serves as a base point, and the other end capable of undergoing restoration displacement, which other end extends to a side of the operation member and can move, the other end being provided with an engagement section, which interferes with a portion of the operation member and locks the lighting operation of the operation member when the engagement section is in the state of the locking during the nonoperating condition of the operation member, wherein the engagement section moves and releases the interference with the operation member in accordance with a lock releasing operation of the protection frame, the lighting operation is carried out in this state by operating the operation member, and the engagement section automatically returns to the state of the locking in accordance with a returning movement of the operation member to its original position and a restoration movement of the protection frame.

The fourth safety device in a lighting rod in accordance with the present invention should preferably be constituted such that a projection may be formed on a side surface of the operation member, such that the engagement section of the protection frame may interfere with the projection of the operation member, and such that the engagement section of the protection frame may move to a position, that does not interfere with the projection of the operation member in accordance with the lock releasing deformation of the protection frame.

Also, the fourth safety device in a lighting rod in accordance with the present invention should preferably be constituted such that the other end of the protection frame may be capable of undergoing resilient deformation by taking the one end of the protection frame as the base point and may move with the restoring force, which is due to the resilient deformation, from the state of the lock release to the position for the locking.

With the first safety device in a lighting rod in accordance with the present invention, when the locking member is projected by the urging member and is thus located at the position for the locking, the engagement section of the locking member is in the state of interference with the operation member. In this state, the engagement section of the locking member obstructs the movement of the operation member and thereby locks the lighting operation. When the lock releasing section of the locking member is operated in the immersing direction against the urging force of the urging member and is thereby moved to the position for the lock release, the engagement section also moves in the immersing direction and is released from the interference with the operation member. As a result, the movement of the operation member becomes possible. By the operation of the operation member, the fuel gas is jetted from the gas tank and lighted. When the operations of the operation member and the locking member are released, the operation member returns to its original position, and the engagement section of the locking member is moved by the urging force of the urging member to the position, at which the engagement section of the locking member interferes with a portion of the operation member. In this manner, the engagement section of the locking member automatically returns to the state of the lock of the lighting operation. Therefore, when the lighting rod is not used, the lighting operation of the operation member is always made impossible, and careless lighting operations can be prevented. Accordingly, a lighting rod, which is very safe, can be obtained.

Also, with the first safety device in a lighting rod in accordance with the present invention, wherein the direction, in which the locking member is operated for the lock release, and the direction, in which the operation member is operated for the lighting, are different from each other, it can be rendered difficult for persons, who do not know how to use the lighting rod appropriately, to release the lock, and careless lighting can thereby be prevented.

With the second safety device in a lighting rod in accordance with the present invention, when the lock releasing section of the locking member is projected from the main body by the urging member, and the locking member is thus located at the position for the locking, the locking member is in the state of interference with the operation member. In this state, the locking member obstructs the movement of the operation member and thereby locks the lighting operation. When the lock releasing section of the locking member is operated in the immersing direction against the urging force of the urging member and is thereby moved to the position for the lock release, the locking member is released from the interference with the operation member. As a result, the movement of the operation member becomes possible. By the operation of the operation member, the fuel gas is jetted from the gas tank and lighted. When the operations of the operation member and the locking member are released, the operation member returns to its original position, and the locking member is moved by the urging force of the urging member to the position, at which the locking member interferes with a portion of the operation member. In this manner, the locking member automatically returns to the state of the lock of the lighting operation. Therefore, when the lighting rod is not used, the lighting operation of the operation member is always made impossible, and careless lighting operations can be prevented. Accordingly, a lighting rod, which is very safe, can be obtained.

Also, with the second safety device in a lighting rod in accordance with the present invention, wherein the direction, in which the locking member is operated for the lock release, and the direction, in which the operation member is operated for the lighting, are different from each other, it can be rendered difficult for persons, who do not know how to use the lighting rod appropriately, to release the lock, and careless lighting can thereby be prevented.

With the third safety device in a lighting rod in accordance with the present invention, when the locking member, which is associated with the guide frame such that it can rotate, is located at the position for the locking, a portion of the locking member is located at the position, that interferences with the operation member. In this state, the locking member obstructs the movement of the operation member and thereby locks the lighting operation. When the locking member is operated in the direction for the lock release against the urging force of the urging member, the locking member is released from the interference with the operation member. As a result, the movement of the operation member becomes possible. By the operation of the operation member, the fuel gas is jetted from the gas tank and lighted. When the lock releasing operation of the locking member is released at the time at which the operation member has returned to its original position, the operation member and the locking member return to the state of interference. In this manner, the locking member automatically returns to the state of the lock of the lighting operation. Therefore, when the lighting rod is not used, the lighting operation of the operation member is always made impossible, and careless lighting operations can be prevented. Accordingly, a lighting rod, which is very safe, can be obtained.

Also, with the third safety device in a lighting rod in accordance with the present invention, the locking member may be provided with the projection, which interferes with the operation member, and the operation member may be provided with the groove, through which the projection of the locking member is inserted. In such cases, when the lighting rod is not used, the projection of the locking member interferes with the operation member, and therefore the lighting operation cannot be carried out. When the locking member is rotated to the position for he lock release, the projection of the locking member moves to the position, that coincides with the position of the groove of the operation member. When the operation member is moved for the lighting, the projection of the locking member passes through the groove of the operation member and thus does not interfere with the operation member. In such cases, at the time at which the locking member is being operated to the state of the lock release, the operation member is not locked even after having returned to the original position. Further, the lock releasing operation of the locking member is carried out by a finger of the user, which is different from the finger for operating the operation member. Therefore, when the fuel gas is to be lighted again in cases where it has not been lighted by a single lighting operation of the operation member, it is not necessary for the lock releasing operation to be carried out each time the fuel gas is to be lighted. Accordingly, the third safety device in a lighting rod in accordance with the present invention has good operability.

Further, with the third safety device in a lighting rod in accordance with the present invention, the groove of the operation member may be provided with an engagement section, which comes into contact with the projection of the locking member and restricts the rotation of the locking member to the state of the locking when the projection of the locking member is being inserted through the groove of the operation member. In such cases, even if the lock releasing operation of the locking member is released before the operation member returns to the original position, the returning of the operation member can be carried out. Also, when the operation member has returned to the original position, it can be locked automatically.

With the fourth safety device in a lighting rod in accordance with the present invention, when the protection frame is in the state of the locking, the engagement section of the protection frame is located at the position, that interferences with a portion of the operation member. In this state, the engagement section of the protection frame obstructs the movement of the operation member and thereby locks the lighting operation. When the protection frame is operated in the direction for the lock release against the restoring force of the protection frame, the engagement section of the protection frame is released from the interference with the operation member. As a result, the movement of the operation member becomes possible. By the operation of the operation member, the fuel gas is jetted from the gas tank and lighted. When the operations of the operation member and the protection frame are released, the portion of the operation member and the engagement section of the protection frame are restored to the state of interference in accordance with the returning movement of the operation member. In this manner, the engagement section of the protection frame automatically returns to the state of the lock of the lighting operation. Therefore, when the lighting rod is not used, the lighting operation of the operation member is always made impossible, and careless lighting operations can be prevented. Accordingly, a lighting rod, which is very safe, can be obtained.

Also, with the fourth safety device in a lighting rod in accordance with the present invention, the locking of the operation member and the lock release are carried out by utilizing the displacement of the protection frame, which is comparatively large. Therefore, the amount of displacement in the lock releasing operation can be kept large, the lock releasing operation can be carried out reliably, and good operability can be obtained. In particular, in cases where the resilient deformation of the protection frame is utilized, the returning movement of the protection frame from the state of the lock release to the state of the locking can be carried out without an additional urging member being provided.

Further, with the fourth safety device in a lighting rod in accordance with the present invention, in the state in which the protection frame is displaced and is thus releasing the lock, the operation member is not locked even after having returned to the original position. Further, the lock releasing operation of the protection frame is carried out by a finger of the user, which is different from the finger for operating the operation member. Therefore, when the fuel gas is to be lighted again in cases where it has not been lighted by a single lighting operation of the operation member, it is not necessary for the lock releasing operation to be carried out each time the fuel gas is to be lighted. Accordingly, the fourth safety device in a lighting rod in accordance with the present invention has good operability.

Moreover, with the fourth safety device in a lighting rod in accordance with the present invention, wherein the lock of the lighting operation is released by deforming the protection frame, which is ordinarily fixed, it can be rendered difficult for persons, who do not know how to use the lighting rod appropriately, to release the lock, and careless lighting can thereby be prevented.

DESCRIPTION OF THE PREFERRED EMBODIMENTS

The present invention will hereinbelow be described in further detail with reference to the accompanying drawings.

A first embodiment of the safety device in a lighting rod in accordance with the present invention will be described hereinbelow.

Figure 1:
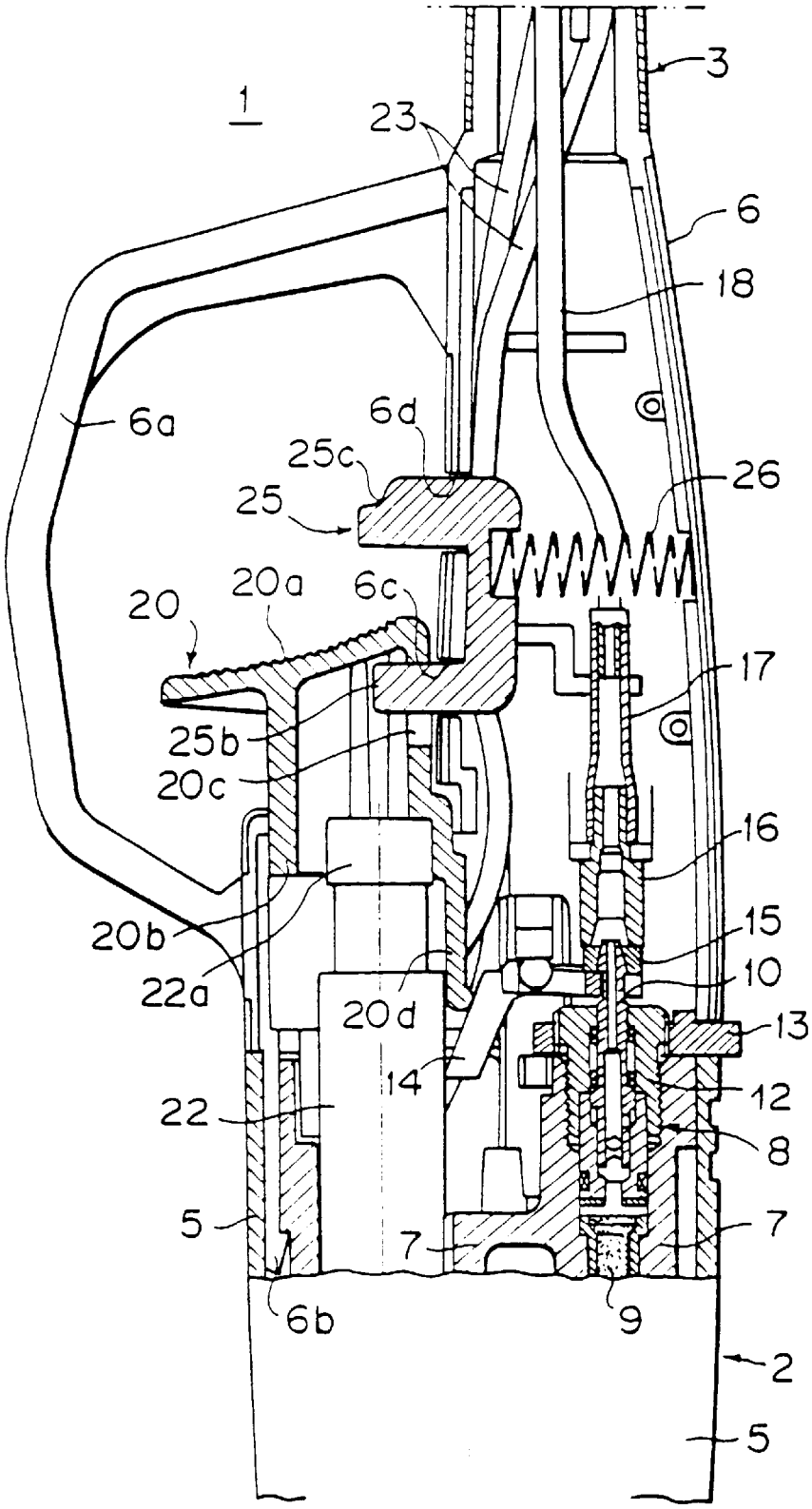
FIG. 1 is a vertical sectional side view showing the major part of a lighting rod, in which a first embodiment of the safety device in accordance with the present invention is employed.
Figure 2:
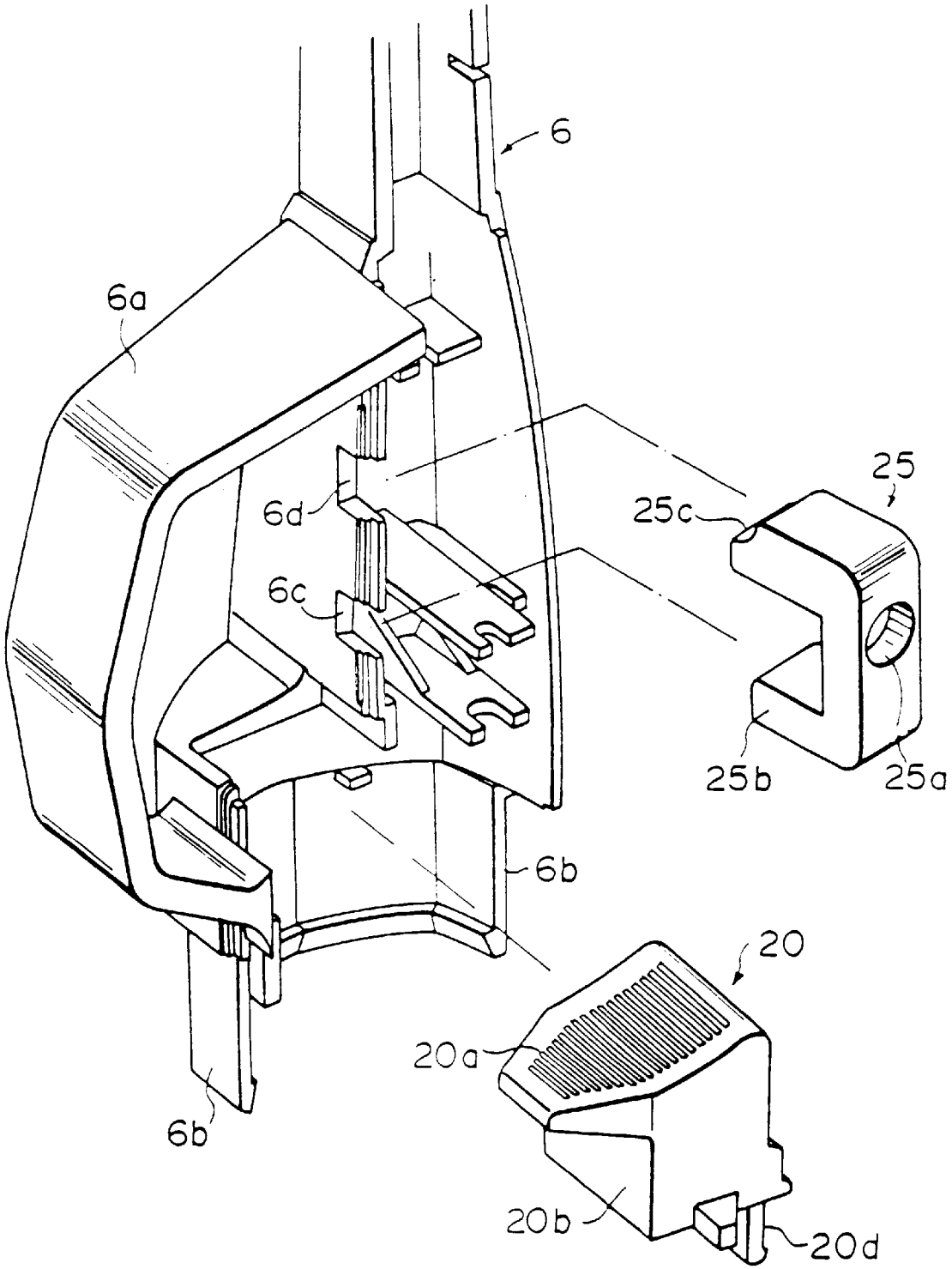
FIG. 2 is an exploded perspective view showing an intermediate case housing, an operation member, and a locking member in the first embodiment of FIG. 1, FIGS. 3A and 3B are sectional side views showing the major part of the lighting rod, the views serving as an aid in explaining how the first embodiment of FIG. 1 operates.
Figure 3B:
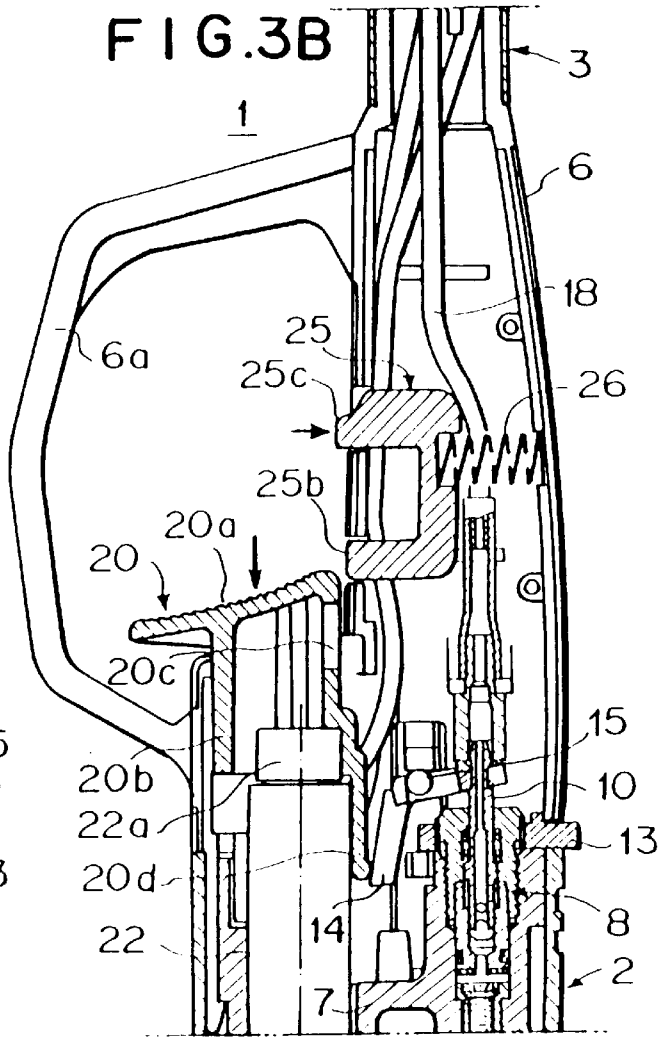
Figure 3A:
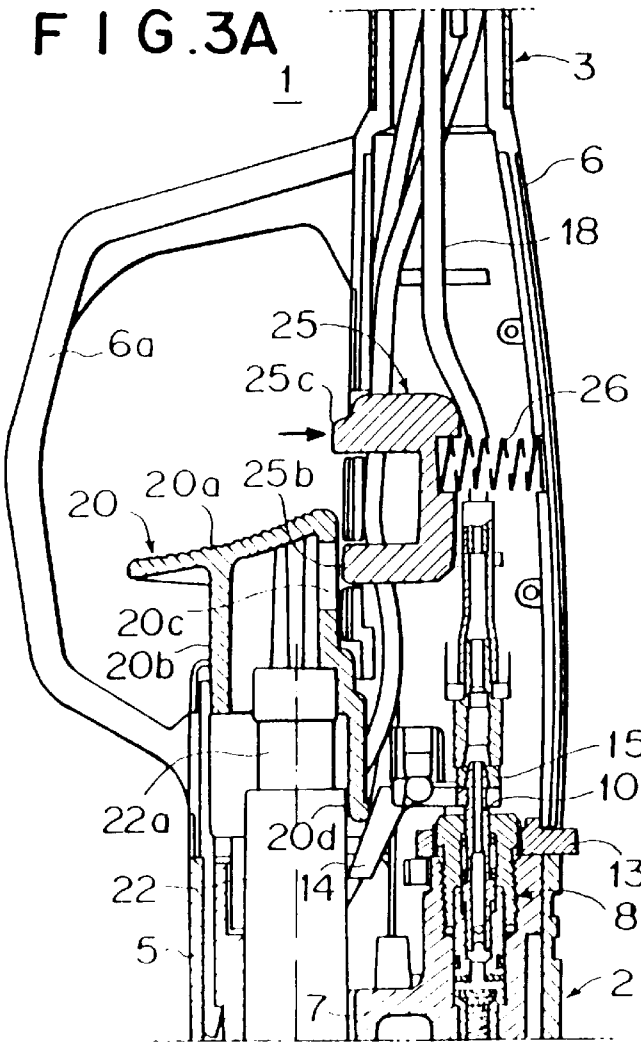

FIG. 1 is a vertical sectional side view showing the major part of a lighting rod, in which the first embodiment of the safety device in accordance with the present invention is employed. FIG. 2 is an exploded perspective view showing an intermediate case housing, an operation member, and a locking member in the first embodiment of FIG. 1. FIGS. 3A and 3B are sectional side views showing how the first embodiment of FIG. 1 operates.

A lighting rod 1 comprises a main body 2 and an extension 3, which has a rod-like shape and extends from the main body 2. (A top end of the extension 3 is not shown in FIG. 1.) The case housing of the main body 2 is constituted of a tank cover 5, which is located on the base end side of the main body 2, and an intermediate case housing 6, which is located on the side forward from the tank cover 5 (i.e., on the upper end side of the main body 2 in FIG. 1). The tank cover 5 is constituted of a synthetic resin such that it may have a case-like shape having a bottom and an open forward end. The intermediate case housing 6 is divided into two parts approximately along a vertical center line. One of the two divided parts is shown in FIG. 2.

A gas tank 7 is located on the base end side of the main body 2. The gas tank 7 is formed from a synthetic resin and accommodates a high pressure gas, such as a butane gas. A valve mechanism 8, which opens and closes a gas flow path, is located at an upper wall of the gas tank 7. The gas is fed to the valve mechanism 8 through a core 9, which is inserted into the gas tank 7. A nozzle member 10 is interleaved in the gas flow path. One end of a rotatable lever 14, which operates the nozzle member 10 in order to open and close the gas flow path, is engaged with a portion of the nozzle member 10 adjacent to its top end. When the nozzle member 10 is moved forwardly by the rotatable lever 14, the gas flow path is opened, and the gas is supplied through the gas flow path. When the nozzle member 10 retracts to the original position by the urging force of a spring, which is located in the valve mechanism 8, the gas flow path is closed, and the supply of the gas is ceased. The gas supply rate, i.e. the size of a flame produced, is adjusted by rotating a flame adjusting knob 13, which is associated with an adjustment sleeve 12 of the valve mechanism 8 and is projected to the exterior of the main body 2.

A shield packing 15, which is constituted of an elastic material, is fitted to the top end of the nozzle member 10. A sleeve member 16, which is in contact with the shield packing 15, is located along a line extending from the nozzle member 10. One end of a connector pipe 17 is connected to an upper end of the sleeve member 16, and the other end of the connector pipe 17 is connected to an end of a gas pipe 18. The gas pipe 18 extends to the top end of the extension 3 and is connected to a jetting nozzle (not shown) in order to supply the gas to it.

Also, an operation member (a lighting lever) 20 is located along a side of the valve mechanism 8 in the intermediate case housing 6 of the main body 2. The operation member 20 can slide along the center line of the valve mechanism 8. A piezo-electric unit 22 is located between the operation member 20 and the gas tank 7.

The operation member 20 has a box-like section 20*b*, which is supported by the intermediate case housing 6 such that it can slide. An operating section 20*a* is obliquely formed at the top end of the box-like section 20*b*. An engagement hole 20*c* is formed in the side surface of the box-like section 20*b*, which side surface is located on the side of the valve mechanism 8. The lower end of the side surface of the box-like section 20*b*, which side surface is located on the side of the valve mechanism 8, continues into a projection 20*d*, which extends in the direction, along which the box-like section 20*b* slides. When the operation member 20 is pushed down in order to light the gas, the projection 20*d* pushes the end of the rotatable lever 14 down and thereby rotates the rotatable lever 14.

Specifically, the rotatable lever 14 has an approximately L-shaped form and is supported such that it can rotate around a fulcrum, which is located at an intermediate point of the rotatable lever 14. As described above, the rotatable lever 14 is rotated by the projection 20*d* of the operation member 20. When the operation member 20 is moved for the lighting operation, the rotatable lever 14 is rotated in order to pull out the nozzle member 10 of the valve mechanism 8. As a result, the gas flow path is opened, and the gas is supplied to the jetting nozzle.

The piezo-electric unit 22 supplies a discharge voltage to an electrical discharge electrode. The piezo-electric unit 22 has a slide section 22*a* for expansion and contraction, which is fitted into the box-like section 20*b* of the operation member 20. When the operation member 20 is pushed down, the slide section 22*a* immerses and causes the piezo-electric unit 22 to generate the discharge voltage. Two lead wires 23, 23 are connected to electrodes of the piezo-electric unit 22 and extend in the extension 3 to the top end of the extension 3. At the top end of the extension 3, the lead wires 23, 23 are connected to the jetting nozzle and the electrical discharge electrode.

The intermediate case housing 6 is provided with a protection frame 6*a*, which surrounds the side outward from the operating section 20*a* of the operation member 20 such that the space, into which the fingers of the user are to be inserted, may be formed. The base portion of the intermediate case housing 6 continues into a tubular connecting section 6*b*. The tubular connecting section 6*b* is coupled with the gas tank 7, and the tank cover 5 is fitted onto the peripheral portion of the tubular connecting section 6*b*.

The lighting rod 1 having the structure described above is also provided with a locking member 25 and an urging member 26, which constitute the safety device for locking the lighting operation of the operation member 20 and for releasing the lock.

As illustrated also in FIG. 2, the locking member 25 has an approximately U-shaped form. The locking member 25 is fitted to the intermediate case housing 6 such that it can slide in a direction intersecting approximately perpendicularly to the axial direction of the intermediate case housing 6, i.e. to the direction along which the operation member 20 moves. The locking member 25 has a recess 25*a* formed at the back portion. One end of the urging member 26 is inserted into the recess 25*a*, and the other end of the urging member 26 is in contact with the opposing inner wall of the intermediate case housing 6. In this manner, the urging member 26 is located in the contracted state between the recess 25*a* of the locking member 25 and the opposing inner wall of the intermediate case housing 6. The locking member 25 is urged by the urging force of the urging member 26 towards the direction, which projects from the intermediate case housing 6 to the exterior, i.e. towards the locking direction.

One end of the approximately U-shaped locking member 25 is formed as an engagement section 25*b*, and the other end is formed as a lock releasing section 25*c*. The engagement section 25*b* and the lock releasing section 25*c* of the locking member 25 can project into and retract from the space defined by the protection frame 6*a* through windows 6*c* and 6*d*, which are formed in the wall of the intermediate case housing 6.

The engagement section 25*b* can be inserted into and engaged with the engagement hole 20*c* of the operation member 20 and can thereby interfere with the operation member 20. When the engagement section 25*b* is engaged with the engagement hole 20*c* of the operation member 20 as shown in FIG. 1, even if the pushing force for pushing the operation member 20 down for the lighting operation is applied to the operation member 20, the operation member 20 comes into contact with the engagement section 25*b*, which has been inserted through the window 6*c*, and cannot be pushed down. The lock releasing section 25*c* can project to the position, which stands facing the vicinity above the operating section 20*a* of the operation member 20. When the lock releasing section 25*c* is pushed into the intermediate case housing 6, the locking member 25 moves to the direction, which immerses against the urging force of the urging member 26.

The operation member 20 and the locking member 25 have the relationship described above. Therefore, when the lock releasing section 25*c* of the locking member 25 and the operating section 20*a* of the operation member 20 are simultaneously operated, and the lock of the lighting operation is thereby released, it becomes possible for the operation member 20 to slide in order to carry out the lighting operation. As the operation member 20 returns to the original position, the locking member 25 automatically returns to the state of the locking of the lighting operation.

How the safety device in the lighting rod 1 operates will be described hereinbelow. First, as illustrated in FIG. 1, when the lighting rod 1 is in the ordinary state (i.e., when it is not used), the locking member 25 is projected from the intermediate case housing 6 by the urging member 26 and is thus located in the position for the locking. In this ordinary state, the engagement section 25*b* of the locking member 25 has been inserted into the engagement hole 20*c* of the operation member 20, and the lock releasing section 25*c* of the locking member 25 is projected through the window 6*d* into the space defined by the protection frame 6*a*. In this state, even if the pushing force is applied to the operation member 20, the operation member 20 cannot be pushed down due to the engagement with the engagement section 25*b* of the locking member 25, and thus the lighting operation cannot be carried out. Therefore, even if persons, who do not know how to use the lighting rod 1 appropriately, operate the lighting rod 1, the gas is not lighted. Accordingly, careless lighting can be prevented.

When the lighting rod 1 is to be used, as illustrated in FIG. 3A, the lock releasing section 25*c* of the locking member 25 is pushed into the intermediate case housing 6. Thereafter, as illustrated in FIG. 3B, the lighting operation is carried out by pushing the operation member 20 down, while the lock releasing section 25*c* is being pushed. When the lock releasing section 25*c* is pushed into the intermediate case housing 6 against the urging force of the urging member 26, the engagement section 25*b*, which is molded integrally with the lock releasing section 25*c*, is also immersed into the intermediate case housing 6 and disengaged from the engagement hole 20*c* of the operation member 20. In this manner, the locking member 25 is set to the state of the lock release, and it becomes possible to push the operation member 20 down.

When the operation member 20 is thus pushed down for the lighting operation, the projection 20*d* of the operation member 20 pushes the end of the rotatable lever 14 and rotates the rotatable lever 14. As a result, the rotatable lever 14 pulls out the nozzle member 10 and opens the gas flow path in the valve mechanism 8. Therefore, the gas is supplied through the gas pipe 18 to the jetting nozzle. Also, as the operation member 20 is operated in this manner, the piezo-electric unit 22 is caused to generate the discharge voltage (an alternating voltage). The discharge voltage is applied across the electrical discharge electrode, which is located at the extension 3, and the jetting nozzle, and the jetted gas is lighted by the discharge voltage.

When the finger of the user is released from the operation member 20 in order to cease the use of the lighting rod 1, the operation member 20 is returned to the original position by the urging force of a spring, which is located in the piezo-electric unit 22. Also, at the time at which the engagement hole 20*c* of the operation member 20 has moved to the position of the engagement section 25*b* of the locking member 25, the locking member 25 is moved by the urging force of the urging member 26 such that the engagement section 25*b* of the locking member 25 may enter into the engagement hole 20*c*, and such that the lock releasing section 25*c* may project to the vicinity above the operating section 20*a*. In this manner, the locking member 25 automatically returns to the state of the locking, in which the operation member 20 cannot be pushed down.

A second embodiment of the safety device in a lighting rod in accordance with the present invention will be described hereinbelow.

Figure 4B:
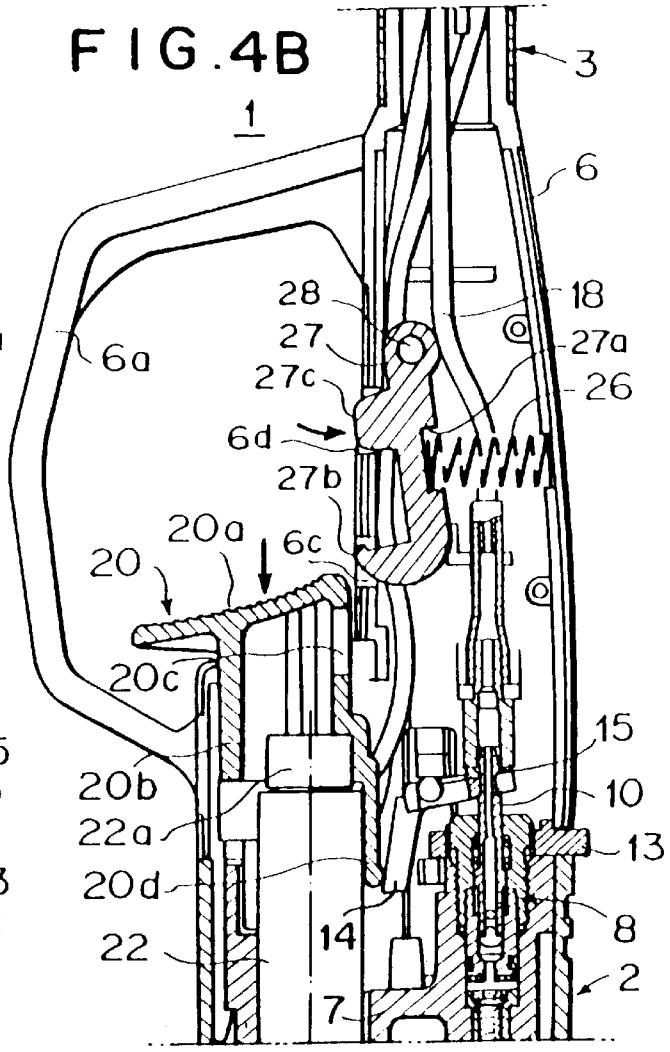
FIGS. 4A and 4B are sectional side views showing the major part of a lighting rod, in which a second embodiment of the safety device in accordance with the present invention is employed.
Figure 4A:
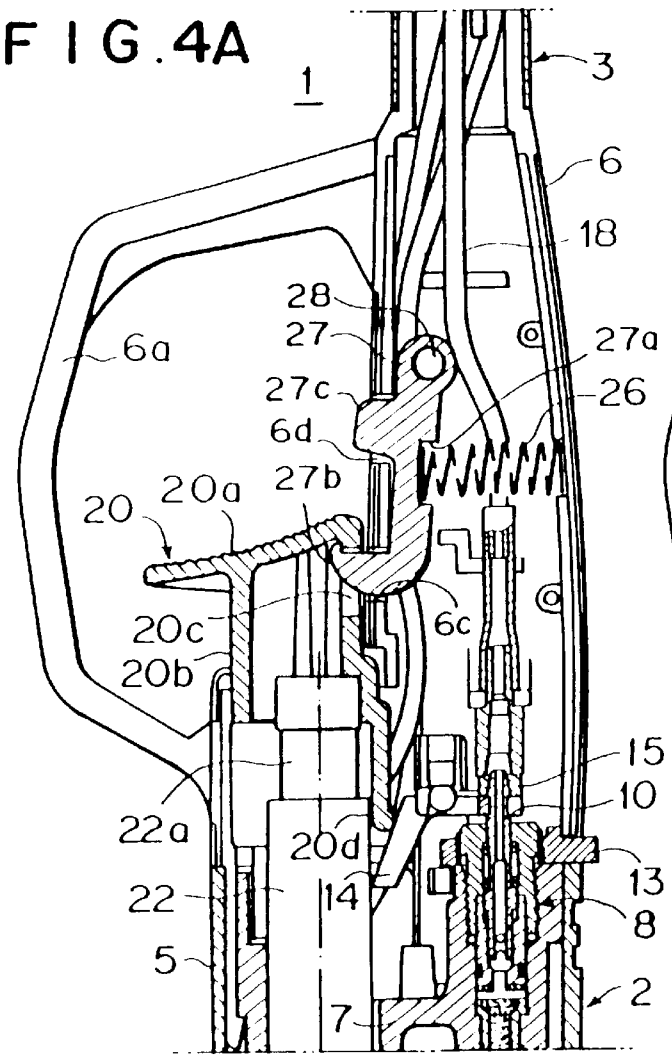

FIGS. 4A and 4B are sectional side views showing the major part of a lighting rod, in which the second embodiment of the safety device in accordance with the present invention is employed. In the second embodiment, a modified form of a locking member is employed. In this embodiment, the basic structures of the valve mechanism 8, the operation member 20, and the like, of the lighting rod 1 are identical with those in the first embodiment. In FIGS. 4A and 4B, similar elements are numbered with the same reference numerals with respect to FIG. 1.

In the second embodiment, a locking member 27 has a recess 27*a* at the back portion. One end of the urging member 26 is inserted into the recess 27*a*. The locking member 27 is also provided with an engagement section 27*b*, which can be engaged with the engagement hole 20*c* of the operation member 20 through the window 6*c* formed in the wall of the intermediate case housing 6. The locking member 27 is further provided with a lock releasing section 27*c*, which can project to the vicinity of the operating section 20*a* of the operation member 20 through the window 6*d* formed in the wall of the intermediate case housing 6.

A portion of an upper end of the lock releasing section 27*c* is extended upwardly. The extension of the lock releasing section 27*c* is supported by a pin 28 such that the locking member 27 can swing with respect to the intermediate case housing 6. The engagement section 27*b* and the lock releasing section 27*c* are urged by the urging force of the urging member 26 towards the direction, which projects from the intermediate case housing 6 to the exterior, i.e. towards the locking direction.

In the second embodiment, the lock of the lighting operation and the release of the lock are carried out in the same manner as that in the first embodiment. From the state of the locking of the lighting operation shown in FIG. 4A, as illustrated in FIG. 4B, the clock is released by pushing the lock releasing section 27*c* of the locking member 27 into the intermediate case housing 6. Thereafter, the operation member 20 is pushed down. In this manner, the lighting operation can be carried out. When the finger of the user is released from the operation member 20 in order to return the operation member 20 to the original position, and thereafter the lock releasing operation of the locking member 27 is released, the locking member 27 automatically returns to the state of the locking.

The bottom surface of the engagement section 27*b* of the locking member 27 has a curved shape. If the lock releasing operation of the locking member 27 is released after the lighting operation has been carried out but before the operation member 20 returns to the original position, the engagement section 27*b* of the locking member 27 will project to the position for the locking. However, in such cases, the top end of the operating section 20*a* of the operation member 20 comes into contact with the curved bottom surface of the engagement section 27*b* and causes the engagement section 27*b* of the locking member 27 to swing and immerse into the intermediate case housing 6. In this manner, the operating section 20*a* of the operation member 20 passes along the engagement section 27*b* of the locking member 27, and the locking member 27 automatically returns to the state of the locking.

A third embodiment of the safety device in a lighting rod in accordance with the present invention will be described hereinbelow.

Figure 5:
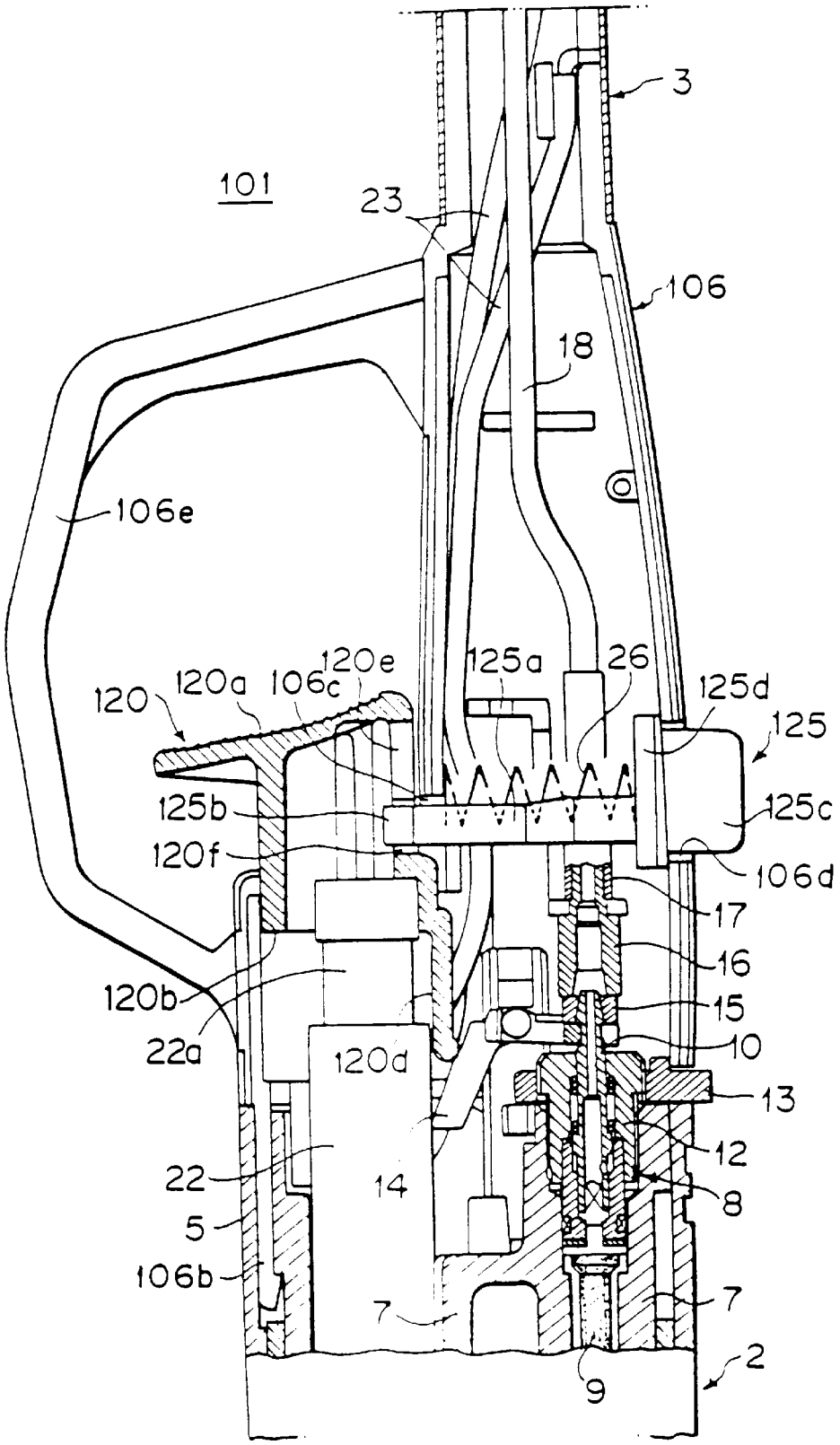
FIG. 5 is a vertical sectional side view showing the major part of a lighting rod, in which a third embodiment of the safety device in accordance with the present invention is employed.
Figure 6:
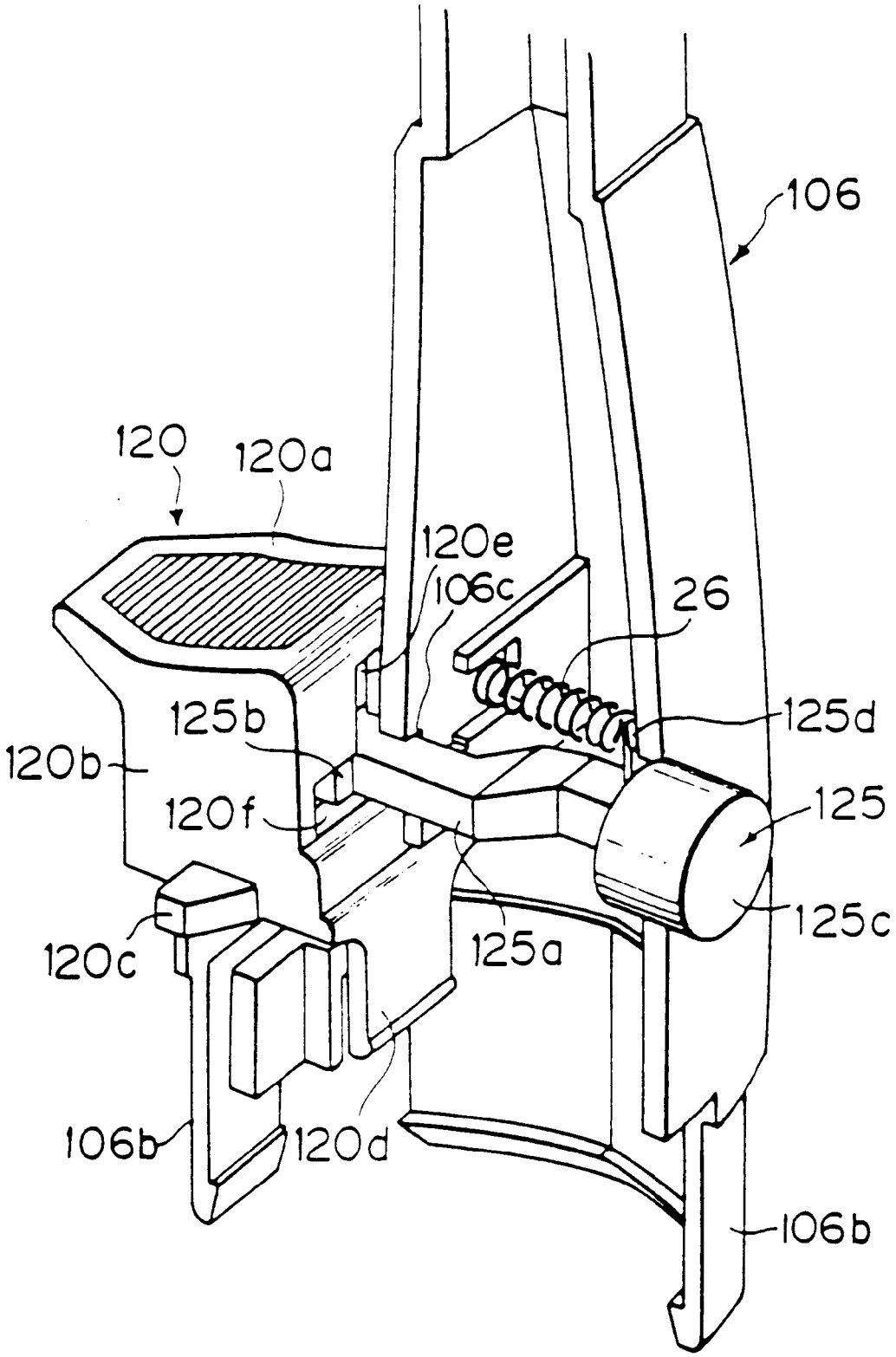
FIG. 6 is a perspective view showing the third embodiment of FIG. 5 with a portion of an intermediate case housing and a portion of an internal structure being omitted.
Figure 7:
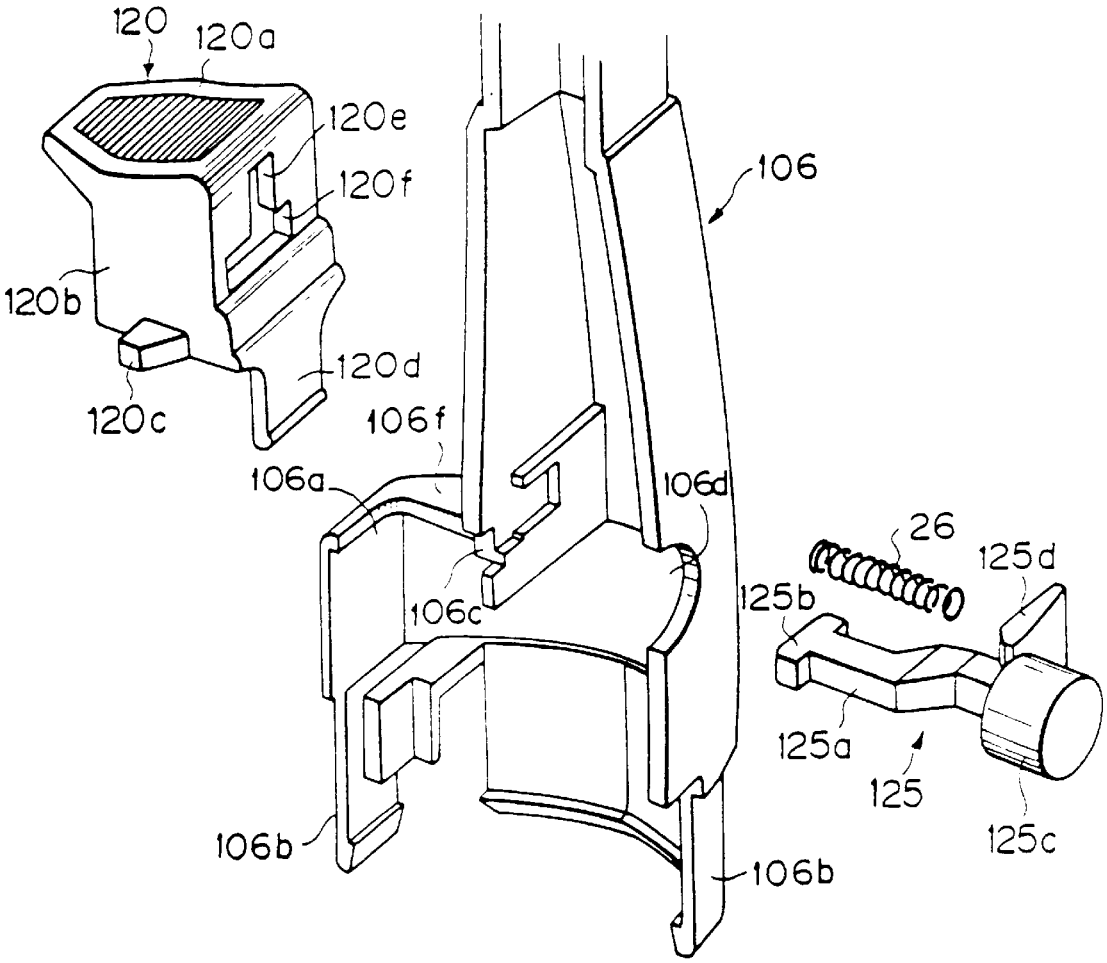
FIG. 7 is an exploded perspective view showing an intermediate case housing, an operation member, and a locking member in the third embodiment of FIG. 5, FIGS. 8A and 8B are sectional side views showing the major part of the lighting rod shown in FIG. 5, the views serving as an aid in explaining how the lock is released.
Figure 8B:
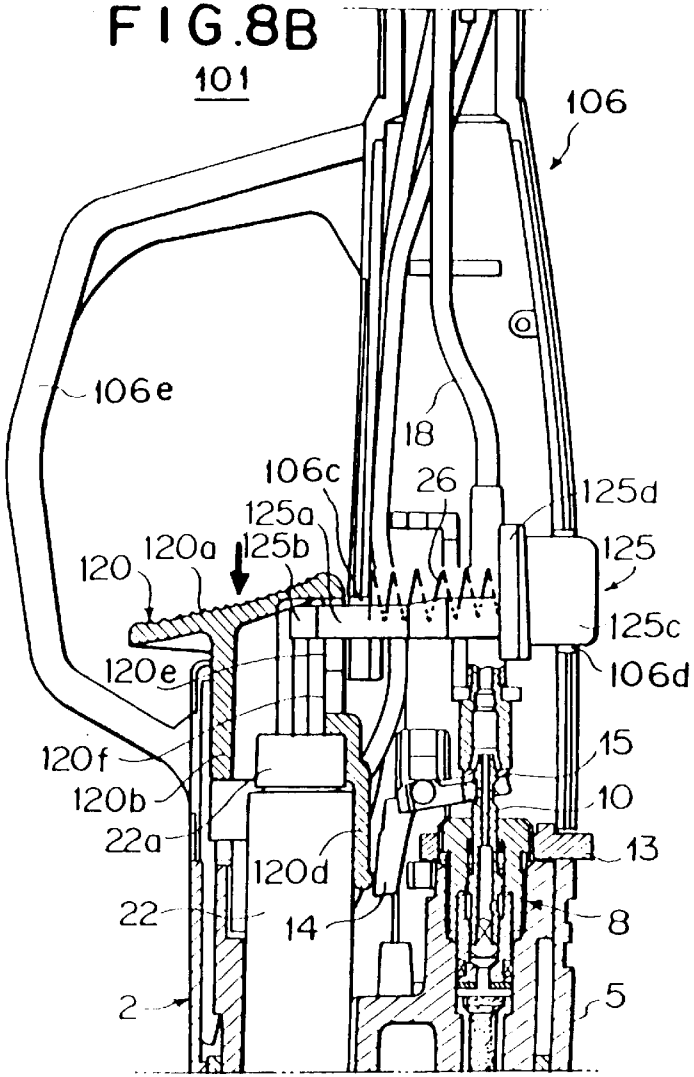
Figure 8A:
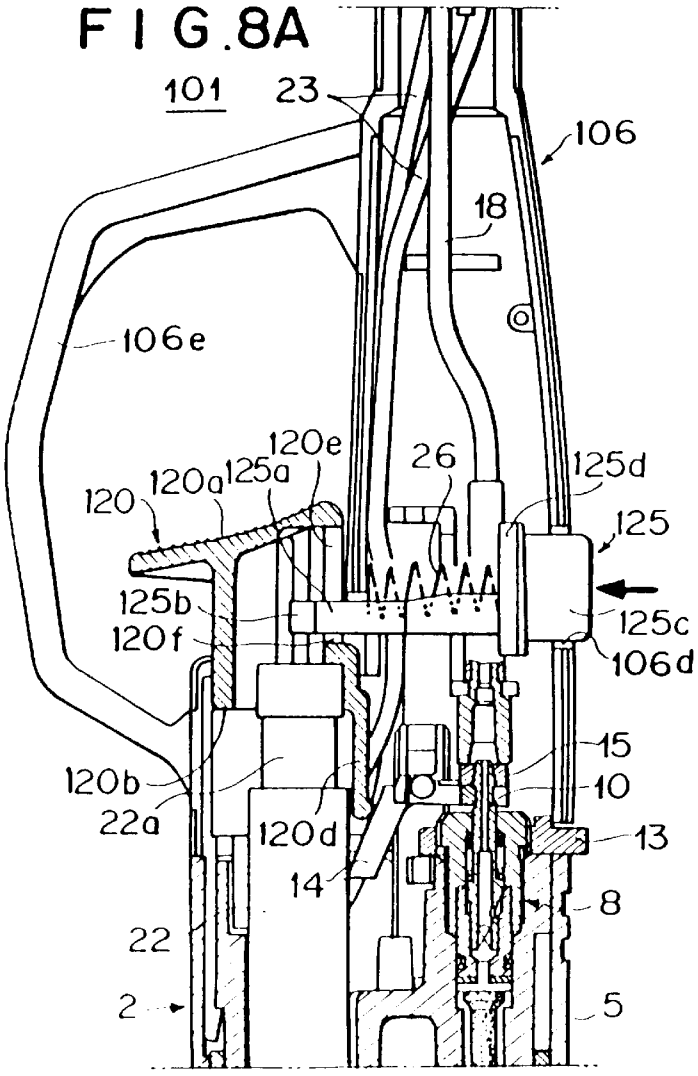

FIG. 5 is a vertical sectional side view showing the major part of a lighting rod, in which the third embodiment of the safety device in accordance with the present invention is employed. FIG. 6 is a perspective view showing the third embodiment of FIG. 5 with a portion of an intermediate case housing and a portion of an internal structure being omitted. FIG. 7 is an exploded perspective view showing an intermediate case housing, an operation member, and a locking member in the third embodiment of FIG. 5. FIGS. 8A and 8B are sectional side views showing the major part of the lighting rod shown in FIG. 5, the views serving as an aid in explaining how the lock is released. In FIG. 5 (and in those that follow), similar elements are numbered with the same reference numerals with respect to FIG. 1.

An intermediate case housing 106 is divided into two parts approximately along a vertical center line. One of the two divided parts is shown in FIGS. 6 and 7. An operation member (a lighting lever) 120 is located along a side of the valve mechanism 8 in the intermediate case housing 106 of the main body 2. The operation member 120 can slide along the center line of the valve mechanism B. The piezo-electric unit 22 is located between the operation member 120 and the gas tank 7.

The operation member 120 has a box-like section 120*b*, which is supported by the intermediate case housing 106 such that it can slide through an opening 106*a* of the intermediate case housing 106 (shown in FIG. 7) into the intermediate case housing 106. An operating section 120*a* is obliquely formed at the top end of the box-like section 120*b*. Projections 120*c*, 120*c* project laterally from the two side surfaces of the box-like section 120*b*. The projections 120*c*, 120*c* come into contact with the inner surface of a wall 106*f* of the intermediate case housing 106, and the position, to which the operation member 120 projects upwardly, is thereby restricted.

The lower end of the side surface of the box-like section 120*b*, which side surface is located on the side of the valve mechanism 8, continues into a leg 120*d*, which extends in the direction, along which the box-like section 120*b* slides. When the operation member 120 is pushed down in order to light the gas, the leg 120*d* pushes the end of the rotatable lever 14 down and thereby rotates the rotatable lever 14. A vertical groove 120*e*, which extends along the direction of the movement of the operation member 120, is formed in the side surface of the operation member 120 between the leg 120*d* and the operating section 120*a*. The lower end of the vertical groove 120*e* continues into an engagement groove 120*f*, which extends in the direction perpendicularly intersecting with the vertical groove 120*f*. The rotatable lever 14 is rotated by the leg 120*d* of the operation member 120.

The slide section 22*a* of the piezo-electric unit 22 is fitted into the box-like section 120*b* of the operation member 120. When the operation member 120 is pushed down, the slide section 22*a* immerses and causes the piezo-electric unit 22 to generate the discharge voltage.

The intermediate case housing 106 is provided with a protection frame 106*e*, which surrounds the side outward from the operating section 120*a* of the operation member 120 such that the space, into which the finger of the user is to be inserted, may be formed. The base portion of the intermediate case housing 106 continues into a tubular connecting section 106*b*. The tubular connecting section 106*b* is coupled with the gas tank 7, and the tank cover 5 is fitted onto the peripheral portion of the tubular connecting section 106*b*.

The lighting rod 101 having the structure described above is also provided with a locking member 125 and an urging member 26, which constitute the safety device for locking the lighting operation of the operation member 120 and for releasing the lock.

As illustrated also in FIG. 7, the locking member 125 comprises a rod-like shaft 125*a*, an engagement section 125*b*, which projects in the form of a hook from two side surfaces of an end of the shaft 125*a*, and a lock releasing section 125*c*, which has a cylindrical button-like shape and is located at the other end of the shaft 125*a*. The portion of the shaft 125*a*, which is adjacent to the engagement section 125*b*, and the lock releasing section 125*c* can respectively project from the intermediate case housing 106 through windows 106*c* and 106*d*, which are formed in the wall of the intermediate case housing 106. Also, a portion of the locking member 125, which is located between the lock releasing section 125*c* and the shaft 125*a*, continues into a spring receiver 125*d*, which supports an end of the urging member (a coiled spring) 26.

The other end of the urging member 26 is in contact with the opposing inner wall of the intermediate case housing 106. In this manner, the urging member 26 is located in the contracted state between the spring receiver 125*d* of the locking member 125 and the opposing inner wall of the intermediate case housing 106. The locking member 125 is urged by the urging force of the urging member 26 towards the direction such that the lock releasing section 125*c* may be projected from the intermediate case housing 106 to the exterior, i.e. towards the locking direction.

The engagement section 125*b* of the locking member 125 can be inserted into the window 106*c* and the engagement groove 120*f* of the operation member 120 and can thereby interfere with the operation member 120. When the engagement section 125*b* is engaged with the engagement groove 120*f* of the operation member 120 as shown in FIG. 5, even if the pushing force for pushing the operation member 120 down for the lighting operation is applied to the operation member 120, the box-like section 120*b* of the operation member 120 comes into contact with the upper surface of the engagement section 125*b*, and the operation member 120 cannot be pushed down. The lock releasing section 125*c* can project through the window 106*d* from the wall of the intermediate case housing 106, which is located on the side opposite to the operating section 120*a* of the operation member 120. When the lock releasing section 125*c* is pushed into the intermediate case housing 106, the locking member 125 moves to the direction, which immerses against the urging force of the urging member 26.

When the lock releasing section 125*c* is immersed, the engagement section 125*b*, which is located on the side opposite to the lock releasing section 125*c*, moves from the engagement groove 120*f* into the operation member 120. The, shaft 125*a* of the locking member 125 can slide along the vertical groove 120*e* of the operation member 120.

The operation member 120 and the locking member 125 have the relationship described above. Therefore, when the lock releasing section 125*c* of the locking member 125 and the operating section 120*a* of the operation member 120 are simultaneously operated, and the lock of the lighting operation is thereby released, it becomes possible for the operation member 120 to slide in order to carry out the lighting operation. As the operation member 120 returns to the original position, the locking member 125 automatically returns to the state of the locking of the lighting operation.

How the safety device in the lighting rod 101 operates will be described hereinbelow. First, as illustrated in FIG. 5, when the lighting rod 101 is in the ordinary state (i.e., when it is not used), the locking member 125 is projected from the intermediate case housing 106 by the urging member 26 and is thus located in the position for the locking. In this ordinary state, the engagement section 125*b* of the locking member 125 has been inserted into the engagement groove 120*f* of the operation member 120, and the lock releasing section 125*c* of the locking member 125 is projected to the exterior through the window 106*d*. In this state, even if the pushing force is applied to the operation member 120, the operation member 120 cannot be pushed down due to the engagement of the engagement groove 120*f* and the engagement section 125*b* of the locking member 125, and thus the lighting operation cannot be carried out. Therefore, even if persons, who do not know how to use the lighting rod 101 appropriately, operate the lighting rod 101, the gas is not lighted. Accordingly, careless lighting can be prevented.

When the lighting rod 101 is to be used, as illustrated in FIG. 8A, the lock releasing section 125*c* of the locking member 125 is pushed into the intermediate case housing 106. Thereafter, as illustrated in FIG. 8B, the lighting operation is carried out by pushing the operation member 120 down, while the lock releasing section 125*c* is being pushed. When the lock releasing section 125*c* is pushed into the intermediate case housing 106 against the urging force of the urging member 26, the engagement section 125*b*, which is molded integrally with the lock releasing section 125*c*, moves from the engagement groove 120*f* into the operation member 120, it becomes possible for the shaft 125*a* to slide along the vertical groove 120*e*. In this manner, the locking member 125 is set to the state of the lock release, and it becomes possible to push the operation member 120 down.

When the finger of the user is released from the operation member 120 in order to cease the use of the lighting rod 101, the operation member 120 is returned to the original position by the urging force of a spring, which is located in the piezo-electric unit 22. At this time, the shaft 125*a* slides along the vertical groove 120*e* of the operation member 120. When the force for pushing the lock releasing section 125*c* of the locking member 125 is released, the locking member 125 is moved by the urging force of the urging member 26 such that the engagement section 125*b*may return into the engagement groove 120*f*. The lock releasing section 125*c* thus projects from the intermediate case housing 106 to the exterior. In this manner, the locking member 125 automatically returns to the state of the locking, in which the operation member 120 cannot be pushed down.

In cases where the lock releasing operation of the locking member 125 is released before the operation member 120 returns to the original position, the engagement section 125*b* is in contact with the inner side surface of the operation member 120 on both sides of the vertical groove 120*e* and does not return to the state of the locking. At the time at which the engagement groove 120*f* has moved to the position of the engagement section 125*b*, the engagement section 125*b* enters into the engagement groove 120*f*, and the locking member 125 automatically returns to the state of the locking.

When the locking member 125 is being pushed and the lock release is being continued, even if the operation member 120 returns to the original position, the operation member 120 is not locked. Also, the lock releasing operation of the locking member 125 is carried out with a finger of the user, which is different from the finger for pushing the operation member 120. Therefore, when the fuel gas is to be lighted again in cases where it has not been lighted by a single lighting operation of the operation member, the operation member 120 may be merely pushed down again, and it is not necessary for the lock releasing operation to be carried out each time the fuel gas is to be lighted. Accordingly, the third embodiment has good operability.

A fourth embodiment of the safety device in a lighting rod in accordance with the present invention will be described hereinbelow.

Figure 9:
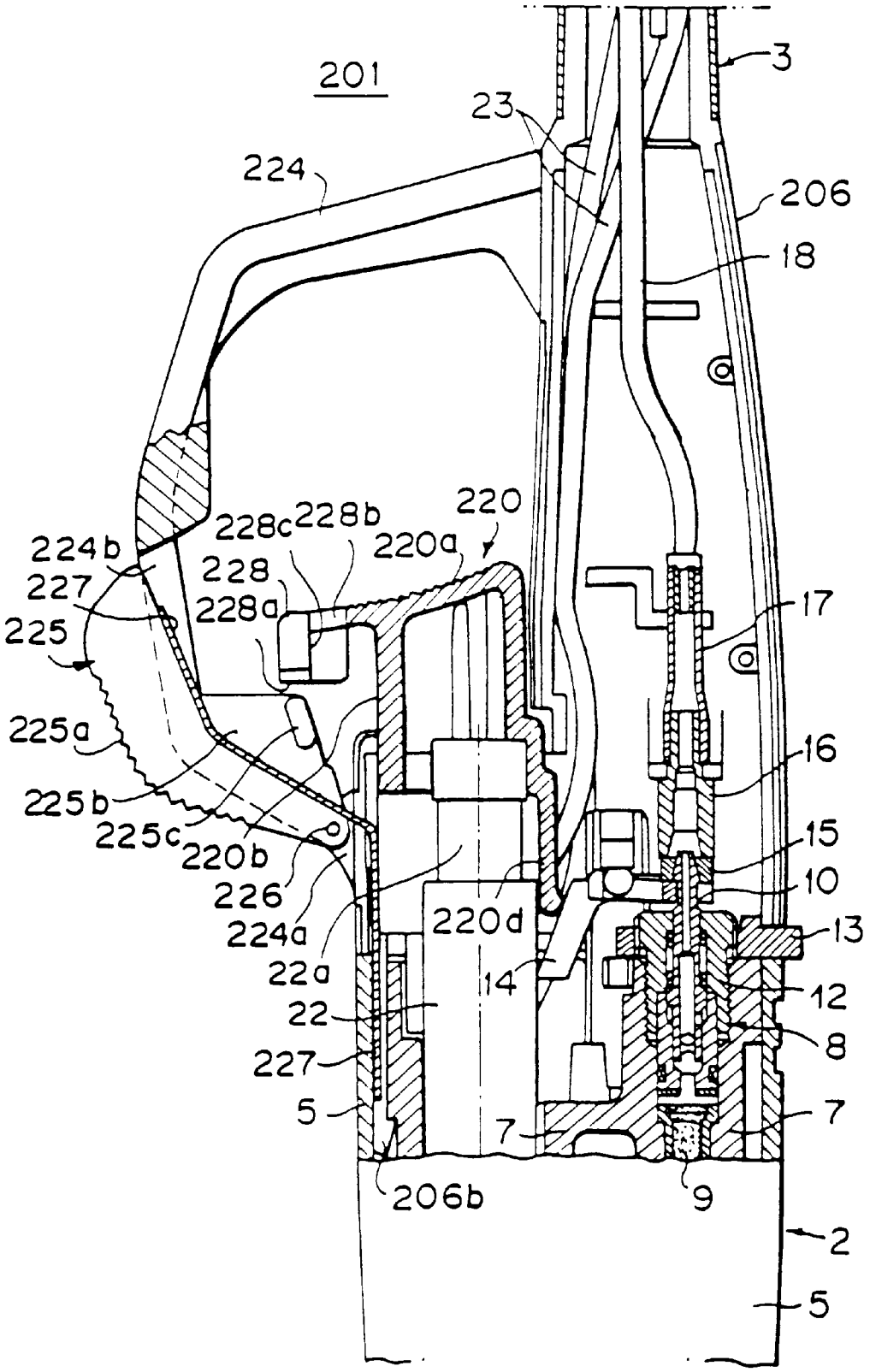
FIG. 9 is a vertical sectional side view showing the major part of a lighting rod, in which a fourth embodiment of the safety device in accordance with the present invention is employed.
Figure 10:
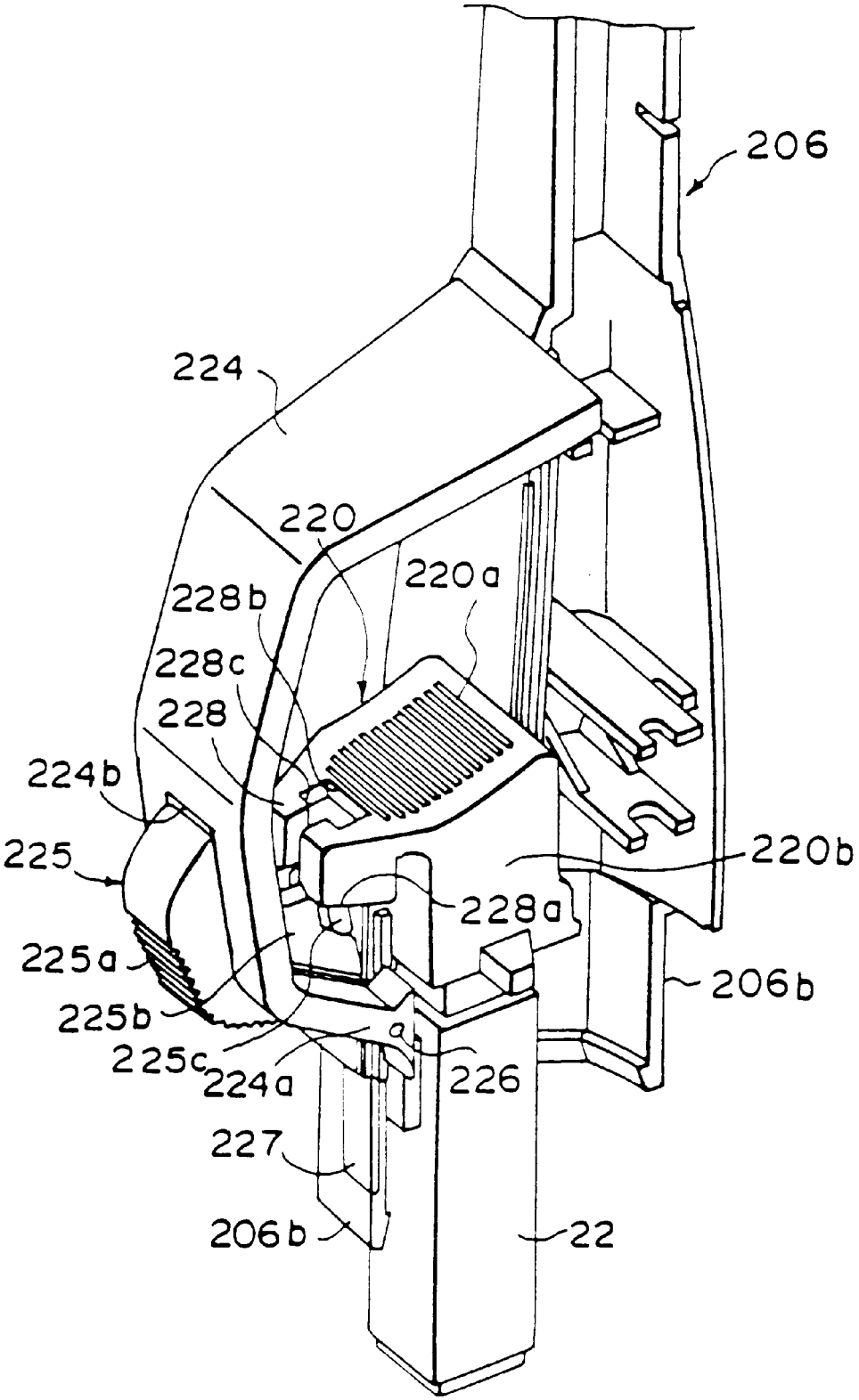
FIG. 10 is a perspective view showing the fourth embodiment of FIG. 9 with a portion of an intermediate case housing and a portion of an internal structure being omitted.
Figure 11:
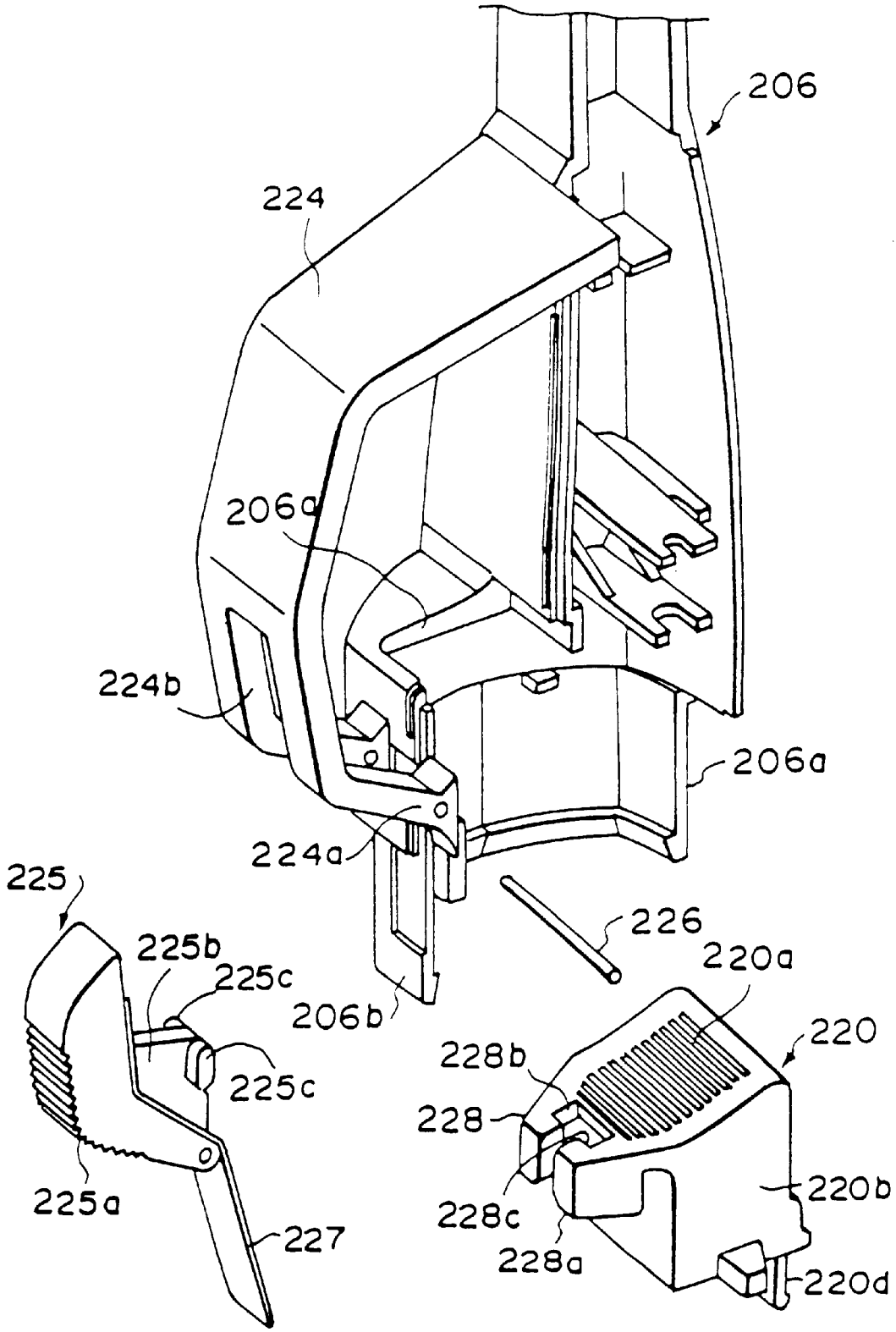
FIG. 11 is an exploded perspective view showing an intermediate case housing, an operation member, and a locking member in the fourth embodiment of FIG. 9.
Figure 12:
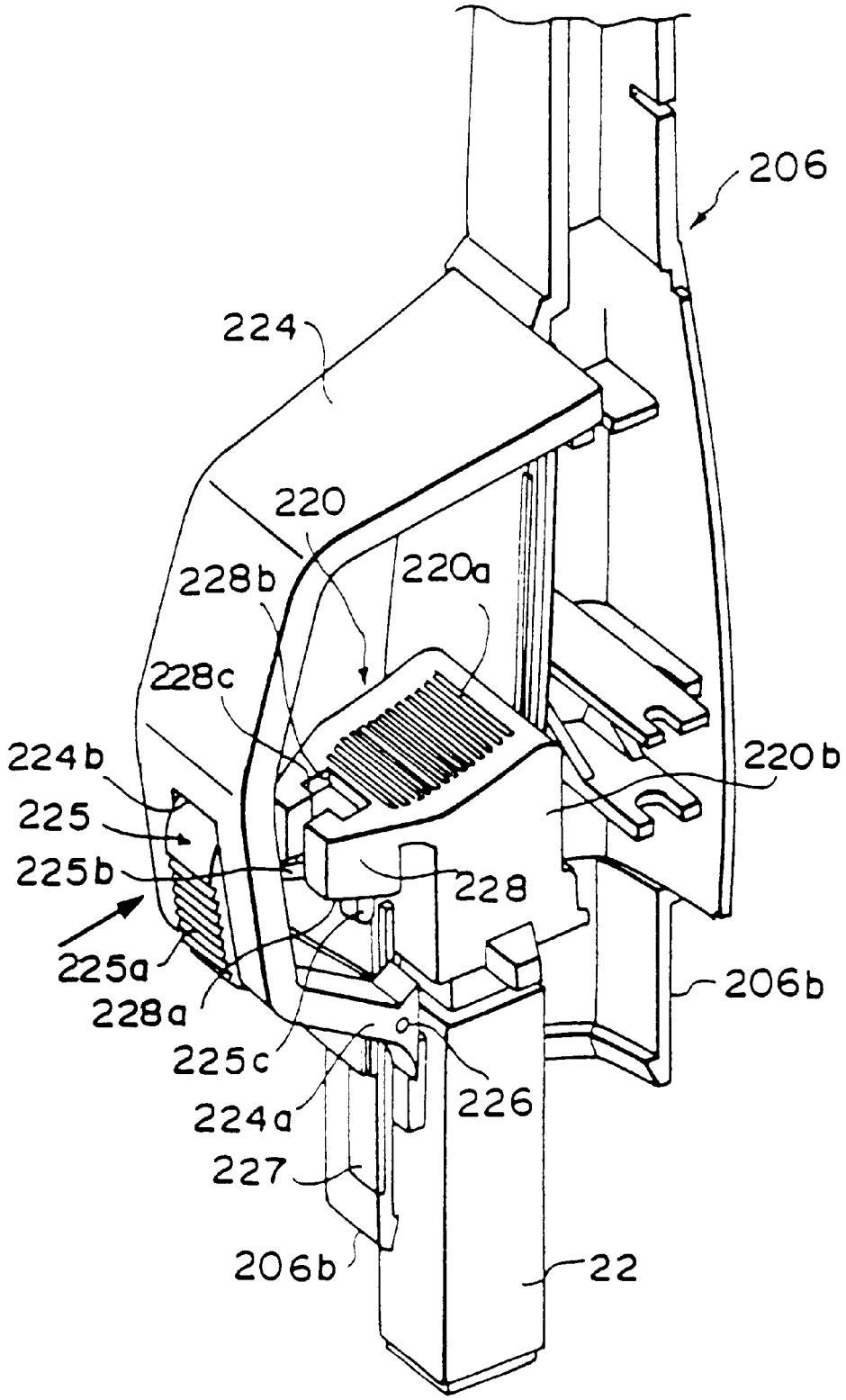
FIG. 12 is a perspective view showing the major part of the lighting rod shown in FIG. 9, the view serving as an aid in explaining how the lock is released.

FIG. 9 is a vertical sectional side view showing the major part of a lighting rod, in which the fourth embodiment of the safety device in accordance with the present invention is employed. FIG. 10 is a perspective view showing the fourth embodiment of FIG. 9 with a portion of an intermediate case housing and a portion of an internal structure being omitted. FIG. 11 is an exploded perspective view showing an intermediate case housing, an operation member, and a locking member in the fourth embodiment of FIG. 9. FIG. 12 is a perspective view showing the major part of the lighting rod shown in FIG. 9, the view serving as an aid in explaining how the lock is released.

An intermediate case housing 206 is divided into two parts approximately along a vertical center line. One of the two divided parts is shown in FIGS. 10, 11, and 12. An operation member (a lighting lever) 220 is located along a side of the valve mechanism 8 in the intermediate case housing 206 of the main body 2. The operation member 220 can slide along the center line of the valve mechanism 8. The piezo-electric unit 22 is located between the operation member 220 and the gas tank 7.

The operation member 220 has a box-like section 220*b*, which is supported by the intermediate case housing 206 such that it can slide through an opening 206*a* of the intermediate case housing 206 (shown in FIG. 11) into the intermediate case housing 206. An operating section 220*a* is obliquely formed at the top end of the box-like section 220*b*. An interference section 228*a*, a groove 228*b*, and an engagement section 228*c*, which will be described later, are formed at an end of an extension continuing from the operating section 220*a*. The lower end of the side surface of the box-like section 220*b*, which side surface is located on the side of the valve mechanism 8, continues into a leg 220*d*, which extends in the direction, along which the—box-like section 220*b* slides. When the operation member 220 is pushed down in order to light the gas, the leg 220*d* pushes the end of the rotatable lever 14 down and thereby rotates the rotatable lever 14. The rotatable lever 14 is rotated by the leg 220*d* of the operation member 220.

The slide section 22*a* of the piezo-electric unit 22 is fitted into the box-like section 220*b* of the operation member 220. When the operation member 220 is pushed down, the slide section 22*a* immerses and causes the piezo-electric unit 22 to generate the discharge voltage.

The intermediate case housing 206 is provided with a guide frame 224, which surrounds the side outward from the operating section 220*a* of the operation member 220 such that the space, into which the finger of the user is to be inserted, may be formed. The intermediate case housing 206 and the guide frame 224 are combined together into an integral body. The base portion of the intermediate case housing 206 continues into a tubular connecting section 206*b*. The tubular connecting section 206*b* is coupled with the gas tank 7, and the tank cover 5 is fitted onto the peripheral portion of the tubular connecting section 206*b*.

The lighting rod 201 having the structure described above is also provided with a safety device for locking the lighting operation of the operation member 220 and for releasing the lock. The safety device is constituted of a locking member 225, which is associated with the guide frame 224, and an extension 228 of the operation member 220.

The guide frame 224 has a base portion 224*a*, which is coupled with the intermediate case housing 206, and a slit-like window 224*b*, which is formed from the base portion 224*a* and is located at the position close to the box-like section 220*b* of the operation member 220. A fulcrum pin 226 is inserted through the base portion 224*a* of the window 224*b*. One end of the locking member 225 is supported by the fulcrum pin 226, and the locking member 225 can rotate within the window 224*b*.

The locking member 225 extends upwardly from the fulcrum and is bent at an intermediate portion. The outer side end surface of the intermediate portion constitutes a lock releasing section 225*a* for carrying out the lock releasing operation (an immersing operation). The lock releasing section 225*a* has approximately the same shape as the outer side shape of the guide frame 224. An urging member 227, which is constituted of a leaf spring, is located along the inner side surface of the locking member 225. The locking member 225 is urged by the urging member 227 towards the projecting direction (the locking direction). The upper half of the urging member 227 is in contact with the inner side surface of the locking member 225. The lower half of the urging member 227 is interleaved between the intermediate case housing 206 and the tank cover 5 and is fixed by them. The original shape of the urging member 227 is set such that it may urge the locking member 225 outwardly by the resilient force.

When the locking member 225 is in the state of the locking as shown in FIGS. 9 and 10, the lock releasing section 225*a* projects from the guide frame 224 to the exterior. The lock releasing section 225*a* can be pushed and moved to the immersing direction against the urging force of the urging member 227.

Figure 13A:
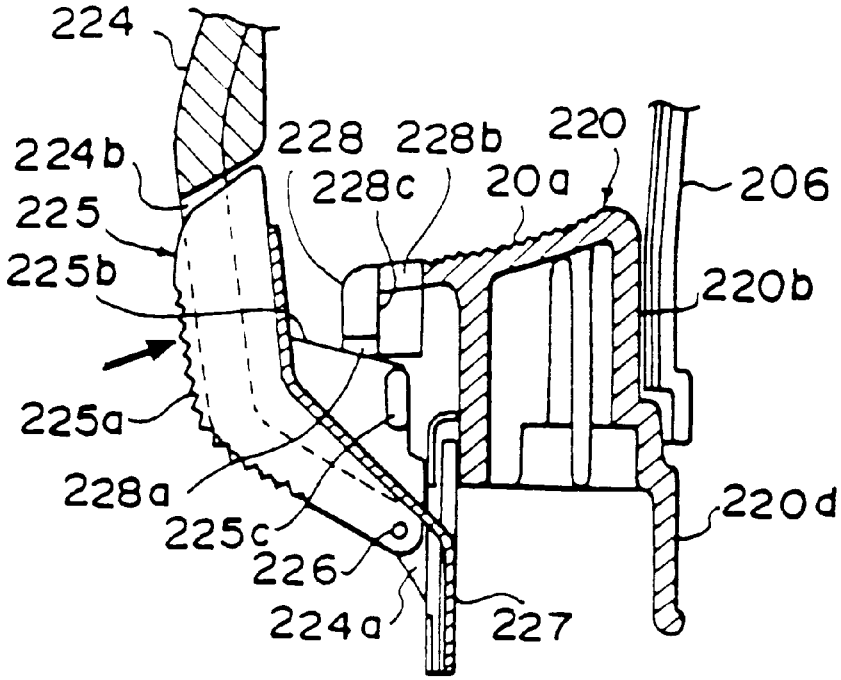
FIGS. 13A and 13B are explanatory views showing how the lock is released.
Figure 13B:
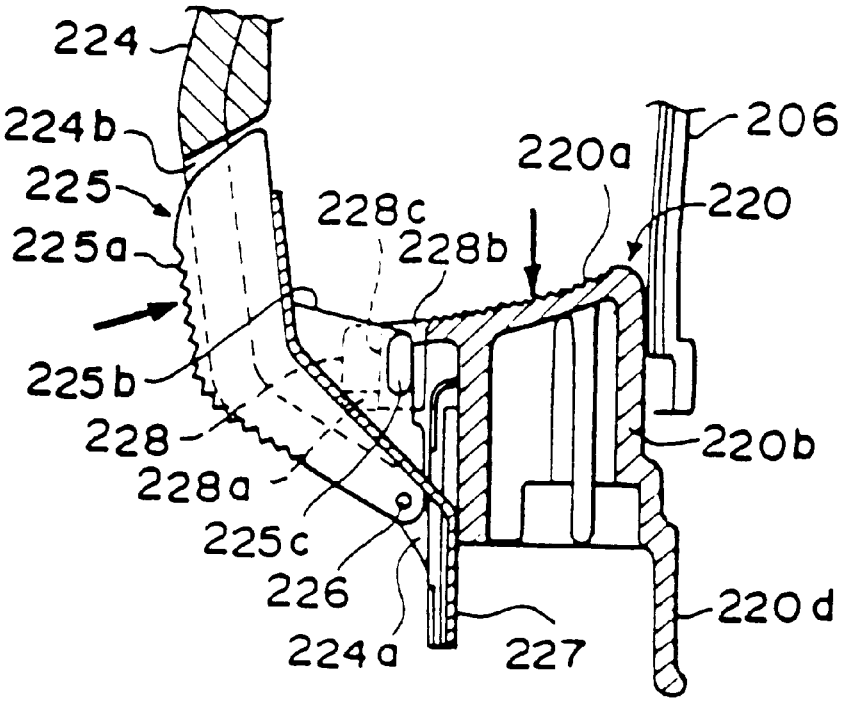

The inner side surface of the locking member 225 stands facing the operation member 220. A vertical wall 225*b* projects inwardly from an approximately middle portion of the lower half of the inner side surface of the locking member 225. The vertical wall 225*b* has an approximately triangular shape, as viewed from a side. Projections 225*c*, 225*c* project from the two sides of the vertex of the approximately triangular vertical wall 225*b*. As illustrated in FIGS. 12, 13A and 13B, when the locking member 225 is immersed and rotated around the fulcrum pin 226 into the state of the lock release, the projections 225*c*, 225*c* move inwardly and become parallel to the direction, along which the operation member 220 moves.

The extension 228 is formed at the end of the operating section 220*a* of the operation member 220. The extension 228 can interfere with the projections 225*c*, 225*c* of the locking member 225. The interference section 228*a* is constituted of the bottom surface of the end of the extension 228. When the locking member 225 is in the state of the locking as shown in FIG. 9, the interference section 228*a* is located above with the projections 225*c*, 225*c* of the locking member 225 and interfere with them, and therefore the operation member 220 cannot be pushed down.

Further, the extension 228 of the operation member 220 is provided with the groove 228*b*, which is located more inward than the interference section 228*a* and into which the projections 225*c*, 225*c* of the locking member 225 can be inserted. Specifically, the groove 228*b* extends in parallel with the direction, along which the operation member 220 moves. The groove 228*b* has an approximately T-shaped form, as viewed from above. When the locking member 225 is moved to the position for the lock release and the operation member 220 is pushed down, the vertical wall 225*b* and the projections 225*c*, 225*c* of the locking member 225 pass through the groove 228*b*. An engagement section 228*c*, which is constituted of a vertically extending wall, is formed on the side surface of the groove 228*b*, which is closer to the locking member 225. When the projections 225*c*, 225*c* of the locking member 225 is being inserted into the groove 228*b*, the engagement section 228*c* prevents the projections 225*c*, 225*c* of the locking member 225 from coming off the groove 228*b*.

The locking member 225 and the extension 228 of the operation member 220 have the relationship described above. Therefore, the projections 225*c*, 225*c* of the locking member 225 and the interference section 228*a* interfere with each other, and the lighting operation is thereby locked. Also, when the lock releasing section 225*a* of the locking member 225 is pushed and the lock of the lighting operation is thereby released, it becomes possible for the operation member 220 to slide in order to carry out the lighting operation. When the operation member 220 returns to the original position and the lock releasing operation of the locking member 225 is released, the projections 225*c*, 225*c* of the locking member 225 automatically return to the state of the locking of the lighting operation.

How the safety device in the lighting rod 201 operates will be described hereinbelow. First, as illustrated in FIGS. 9 and 10, when the lighting rod 201 is in the ordinary state (i.e., when it is not used), the locking member 225 is allowed to stand, and the lock releasing section 225*a* of the locking member 225 is projected from the guide frame 224 by the urging member 227 and is thus located in the position for the locking. In this ordinary state, the projections 225*c*, 225*c* of the locking member 225 are located at the positions, which interfere with the interference section 228*a* of the extension 228 of the operation member 220. In this state, even if the pushing force is applied to the operation member 220, the operation member 220 cannot be pushed down due to the interference of the projections 225*c*, 225*c* of the locking member 225 and the interference section 228*a*, and thus the lighting operation cannot be carried out. Therefore, even if persons, who do not know how to use the lighting rod 201 appropriately, operate the lighting rod 201, the gas is not lighted. Accordingly, careless lighting can be prevented.

When the lighting rod 201 is to be used, as illustrated in FIG. 12, the lock releasing section 225*a* of the locking member 225 is pushed into the window 224*b* against the resilient force of the urging member 227, and the locking member 225 is thereby rotated. While the lock releasing operation is being thus carried out, the lighting operation is carried out by pushing the operation member 220 down. As illustrated in FIG. 13A, when the locking member 225 is thus rotated, the projections 225*c*, 225*c* of the locking member 225 move inwardly from the positions, which interfere with the interference section 228*a* of the operation member 220, to the positions that coincide with the groove 228*b*. In this manner, the projections 225*c*, 225*c* of the locking member 225 are set to the state of the lock release. Therefore, as illustrated in FIG. 13B, it becomes possible for the operation member 220 to be pushed down.

When the finger of the user is released from the operation member 220 in order to cease the use of the lighting rod 201, the operation member 220 is returned to the original position by the urging force of a spring, which is located in the piezo-electric unit 22. Also, when the lock releasing operation of the locking member 225 is released, the locking member 225 is rotated by the resilient force of the urging member 227 such that the lock releasing section 225*a* of the locking member 225 may be projected outwardly from the window 224*b* of the guide frame 224. As a result, the projections 225*c*, 225*c* of the locking member 225 move to the positions, which interfere with the interference section 228*a* of the operation member 220. In this manner, the locking member 225 automatically returns to the state of the locking, in which the operation member 220 cannot be pushed down.

If the lock releasing operation of the locking member 225 is released before the operation member 220 returns to the original position, the locking member 225 will be urged to rotate and return to the projected position. However, in such cases, the projections 225*c*, 225*c* of the locking member 225 come into contact with the engagement section 228*c* of the groove 228*b*, and the locking member 225 does not rotate. At the time at which the operation member 220 has returned to the original position, the projections 225*c*, 225*c* of the locking member 225 are disengaged from the groove 228*b*, and the locking member 225 rotates and returns to the projected position. In this manner, the locking member 225 automatically returns to the state of the locking.

With the fourth embodiment, the lock releasing section 225*a* of the locking member 225 projects from the guide frame 224. Therefore, it is easy to find the portion to be operated. Also, the lock can be released by the operation for gripping the lighting rod 201, and therefore the lighting rod 201 is easy to operate.

When the lock releasing section 225*a* of the locking member 225 is being pushed and the lock release is being continued, even if the operation member 220 returns to the original position, the operation member 220 is not locked. Also, the lock releasing operation of the locking member 225 is carried out with a finger of the user, which is different from the finger for pushing the operation member 220. Therefore, when the fuel gas is to be lighted again in cases where it has not been lighted by a single lighting operation of the operation member, the operation member 220 may be merely pushed down again, and it is not necessary for the lock releasing operation to be carried out each time the fuel gas is to be lighted. Accordingly, the fourth embodiment has good operability.

In the fourth embodiment, the locking member 225 is provided with the projections 225*c*, 225*c*, and the operation member 220 is provided with the groove 228. Conversely, the operation member 220 may be provided with projections, and the locking member 225 may be provided with the groove.

A fifth embodiment of the safety device in a lighting rod in accordance with the present invention will be described hereinbelow.

Figure 14:
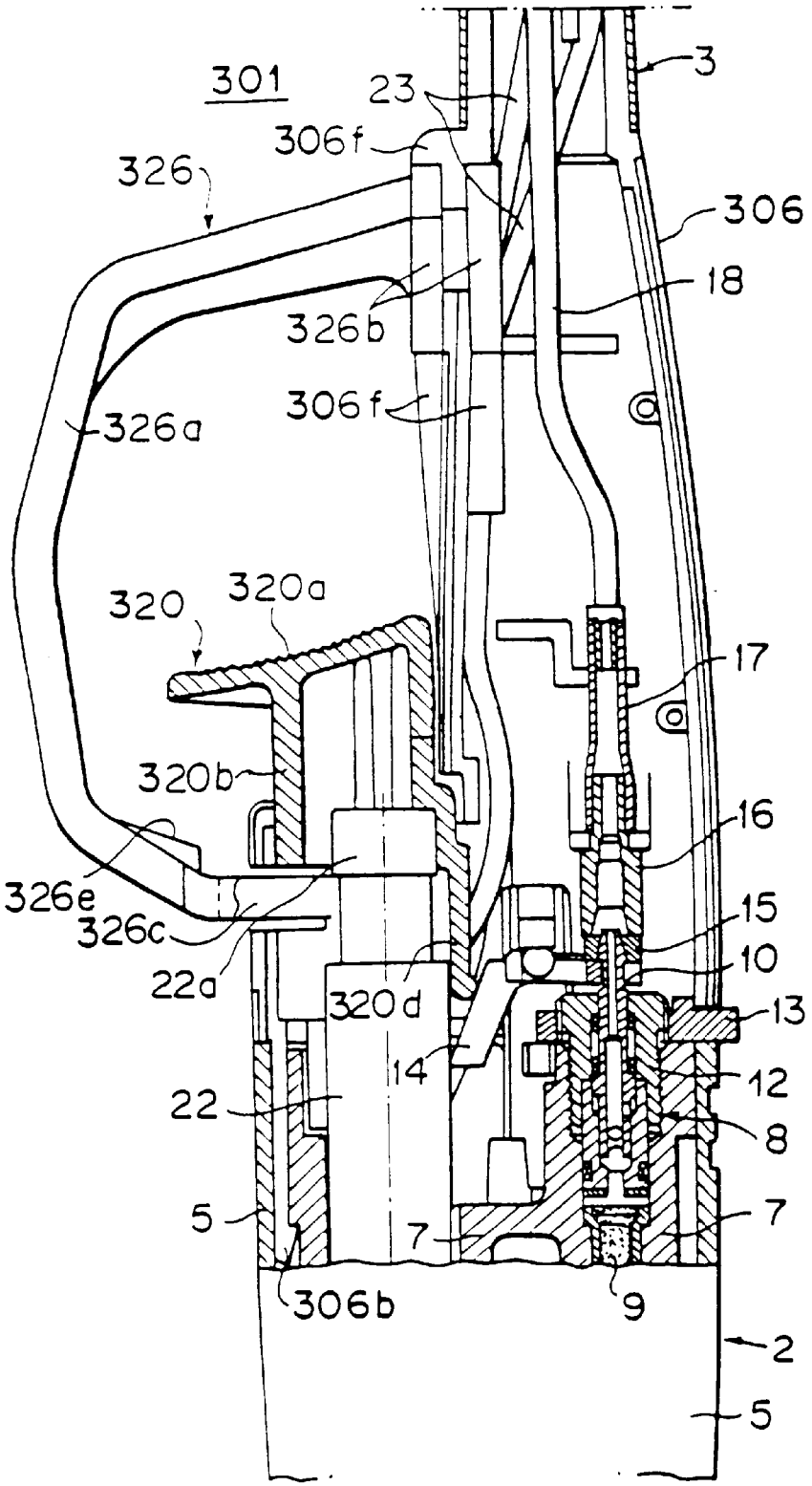
FIG. 14 is a vertical sectional side view showing the major part of a lighting rod, in which a fifth embodiment of the safety device in accordance with the present invention is employed.
Figure 15:
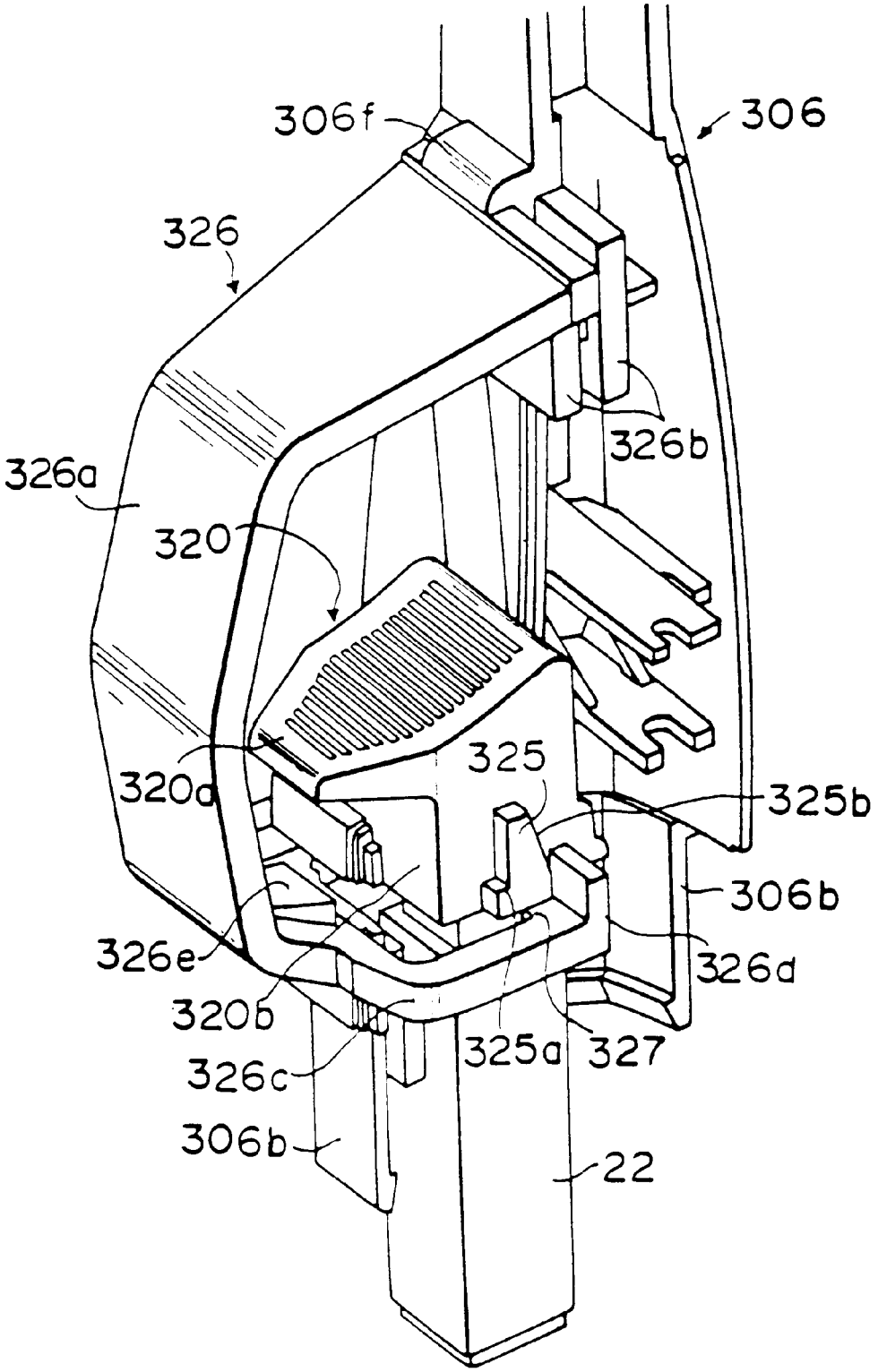
FIG. 15 is a perspective view showing the fifth embodiment of FIG. 14 with a portion of an intermediate case housing and a portion of an internal structure being omitted.
Figure 16:
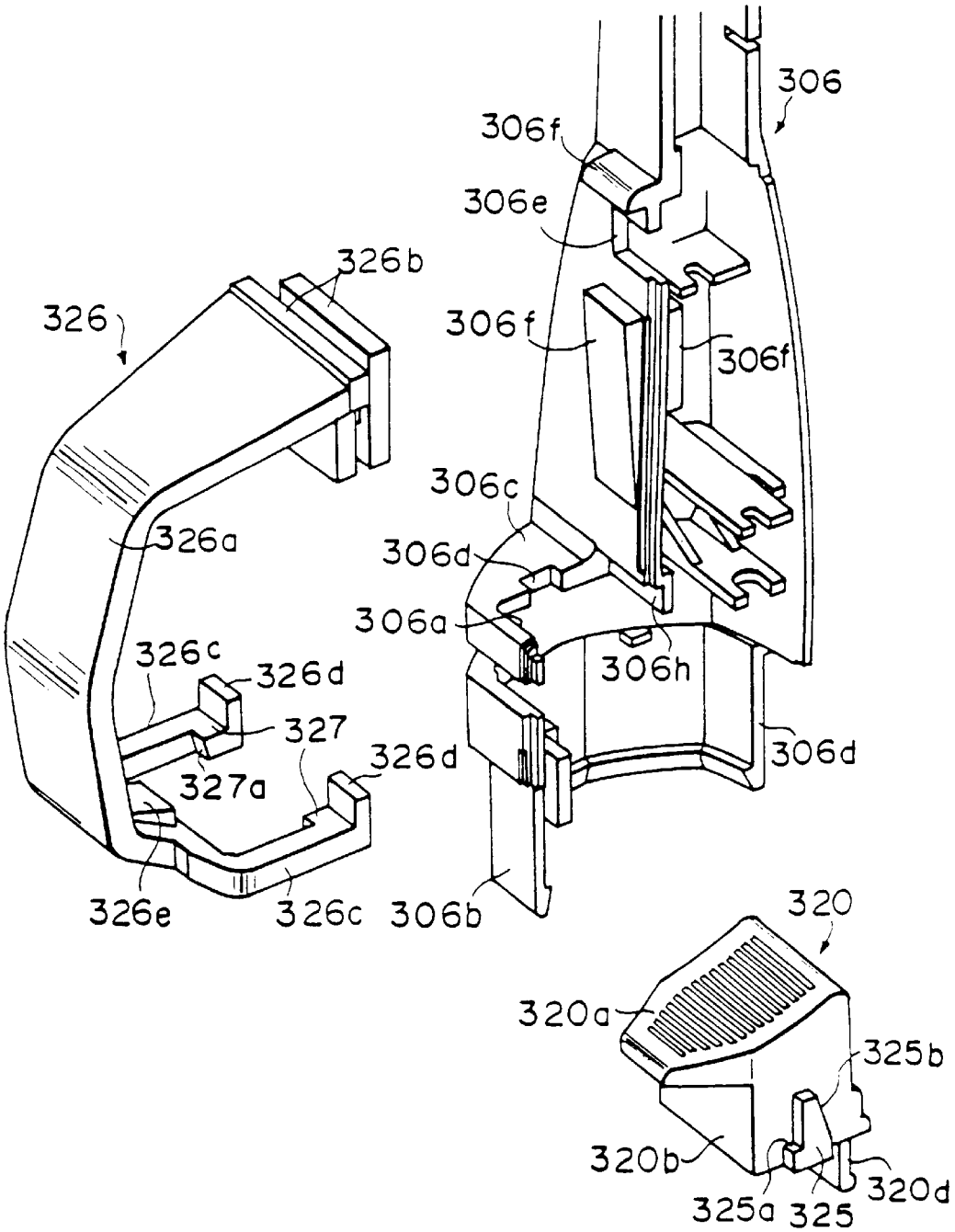
FIG. 16 is an exploded perspective view showing an intermediate case housing, an operation member, and a protection frame in the fifth embodiment of FIG. 14.
Figure 17:
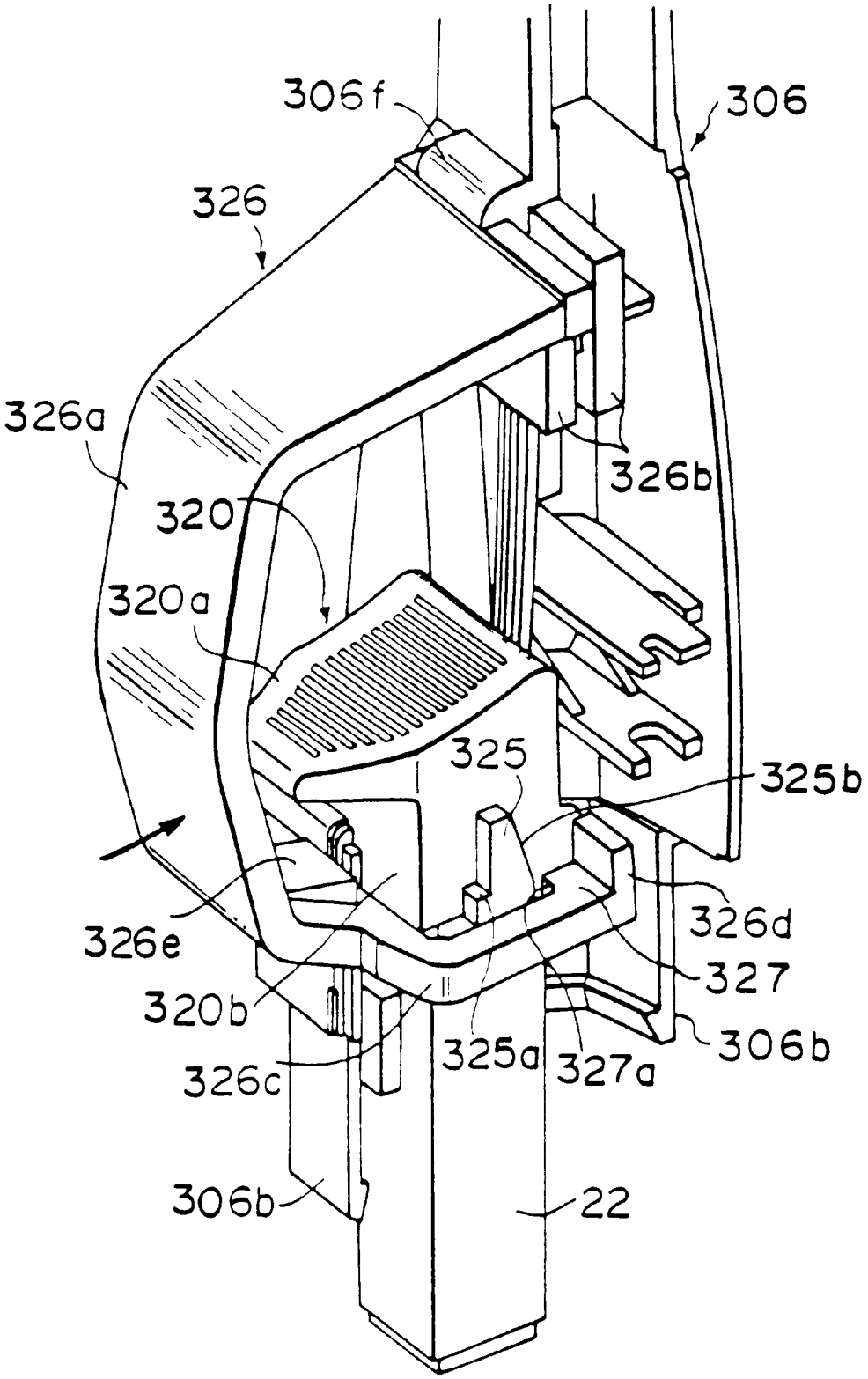
FIG. 17 is a perspective view showing the major part of the lighting rod shown in FIG. 14, the view serving as an aid in explaining how the lock is released.

FIG. 14 is a vertical sectional side view showing the major part of a lighting rod, in which the fifth embodiment of the safety device in accordance with the present invention is employed. FIG. 15 is a perspective view showing the fifth embodiment of FIG. 14 with a portion of an intermediate case housing and a portion of an internal structure being omitted. FIG. 16 is an exploded perspective view showing an intermediate case housing, an operation member, and a protection frame in the fifth embodiment of FIG. 14. FIG. 17 is a perspective view showing the major part of the lighting rod shown in FIG. 14, the view serving as an aid in explaining how the lock is released.

One end of the rotatable lever 14, which operates the nozzle member 10 in order to open and close the gas flow path, is engaged with a portion of the nozzle member 10 adjacent to its top end. The shield packing 15, which is constituted of an elastic material, is fitted to the top end of the nozzle member 10. The other end of the rotatable lever 14 is associated with an operation member 320, which will be describe later. The rotatable lever 14 is pivotably supported by extensions on the two sides of the gas tank 7.

An intermediate case housing 306 is divided into two parts approximately along a vertical center line. One of the two divided parts is shown in FIGS. 15, 16, and 17. The operation member (the lighting lever) 320 is located along a side of the valve mechanism 8 in the intermediate case housing 306 of the main body 2. The operation member 320 can slide along the center line of the valve mechanism 8. The piezo-electric unit 22 is located between the operation member 320 and the gas tank 7.

The operation member 320 has a box-like section 320*b*, which is supported by the intermediate case housing 306 such that it can slide through an opening 306*a* of the intermediate case housing 306 (shown in FIG. 16) into the intermediate case housing 306. An operating section 320*a* is obliquely formed at the top end of the box-like section 320*b*. Projections 325, 325 project laterally from the two side surfaces of the box-like section 320*b*. The lower end of the side surface of the box-like section 320*b*, which side surface is located on the side of the valve mechanism 8, continues into a leg 320*d*, which extends in the direction, along which the box-like section 320*b* slides. When the operation member 320 is pushed down in order to light the gas, the leg 320*d* pushes the end of the rotatable lever 14 down and thereby rotates the rotatable lever 14. The rotatable lever 14 is rotated by the leg 320*d* of the operation member 320.

The slide section 22*a* of the piezo-electric unit 22 is fitted into the box-like section 320*b* of the operation member 320. When the operation member 320 is pushed down, the slide section 22*a* immerses and causes the piezo-electric unit 22 to generate the discharge voltage.

The intermediate case housing 306 is associated with an independent protection frame 326, which surrounds the side outward from the operating section 320*a* of the operation member 320 such that the space, into which the finger of the user is to be inserted, may be formed. The base portion of the intermediate case housing 306 continues into a tubular connecting section 306*b*. The tubular connecting section 306*b* is coupled with the gas tank 7, and the tank cover 5 is fitted onto the peripheral portion of the tubular connecting section 306*b*.

The lighting rod 301 having the structure described above is also provided with a safety device for locking the lighting operation of the operation member 320 and for releasing the lock. The safety device is constituted of the protection frame 326 and the projections 325, 325 of the operation member 320.

Each of the projections 325, 325 of the operation member 320 is formed such that the top end closer to the operating section 320*a* is narrow, and the bottom end remoter from the operating section 320*a* is wide. A step-like portion 325*a* continue from one of the two side surfaces of the bottom end, and the portion of the other side surface, which portion is adjacent to the top end, is formed as a slant surface 325*b*. The top ends of the projections 325, 325 can be inserted into cutaway portions 306*d*, 306*d* (one of them is shown in FIG. 16), which are formed in a wall 306*c* of the intermediate case housing 306. The step-like portions 325*a*, 325*a* of the projections 325, 325 come into contact with the lower surface of the wall 306*c*, and the position, to which the operation member 320 projects, is thereby restricted.

The protection frame 326 comprises a frame body 326*a*, which has a bent shape, and a fixing section 326*b*, which is formed at one end of the frame body 326*a*. The fixing section 326*b* is inserted into an engagement window 306*e* of the intermediate case housing 306. The two plates of the fixing section 326*b* sandwich the wall of the intermediate case housing 306, and are thereby fixed to the intermediate case housing 306. Also, fixing projections 306*f*, 306*f*, . . . are formed on the surfaces of the intermediate case housing 306 at positions above and below the engagement window 306*e*. The upper and lower ends of the two plates of the fixing section 326*b* of the protection frame 326 come into contact with the fixing projections 306*f*, 306*f*, . . . , and the fixing section 326*b* of the protection frame 326 is thereby fixed firmly and reliably to the intermediate case housing 306. The fixing projection 306*f*, which is located close to the operating section 320*a* of the operation member 320, is tapered such that the space defined by the protection frame 326 may be formed by a smooth continuous surface.

The protection frame 326 is supported only at the fixing section 326*b*. The other end portions 326*c*, 326*c* of the frame body 326*a* are inserted into the intermediate case housing 306 such that they can move due to deformation of the protection frame 326. When the protection frame 326 is deformed for the lock release such that the other end portions 326*c*, 326*c* may enter into the intermediate case housing 306, the other end portions 326*c*, 326*c* moves in the direction intersecting approximately perpendicularly to the direction, along which the operation member 320 slides, due to the resilient deformation of the protection frame 326 with the fixing section 326*b* being taken as a base end. In this state, the other end portions 326*c*, 326*c* have the resilient restoring force due to the deformation.

The other end portions 326*c*, 326*c* of the protection frame 326 are spread to opposite sides and extend inwardly along the sides of the operation member 320. The operation member 320 is interleaved between the two other end portions 326*c*, 326*c*. Stoppers 326*d*, 326*d* are formed at the ends of the other end portions 326*c*, 326*c*. The stoppers 326*d*, 326*d* come into contact with the projections 325, 325 of the operation member 320 from the inward sides of the projections 325, 325, and the positions, to which the other end portions 326*c*, 326*c* project outwardly, are thereby restricted. Also, when the protection frame 326 is deformed for the lock release, and the other end portions 326*c*, 326*c* are thereby pushed into the intermediate case housing 306, the stoppers 326*d*, 326*d* come into contact with an opening edge 306*h* of the intermediate case housing 306, and the positions, to which the other end portions 326*c*, 326*c* can be pushed inwardly, are thereby restricted.

Figure 18A:
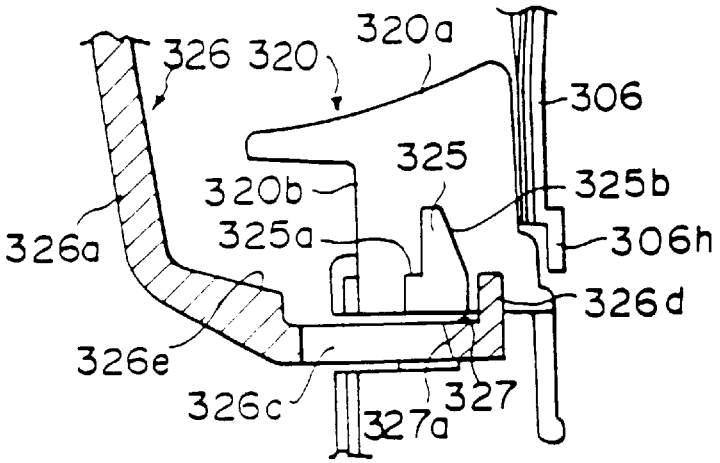
FIGS. 18A, 18B, and 18C are explanatory views showing positional relationship between the state of the locking and the state of the lock release in the fifth embodiment of FIG. 14.
Figure 18B:
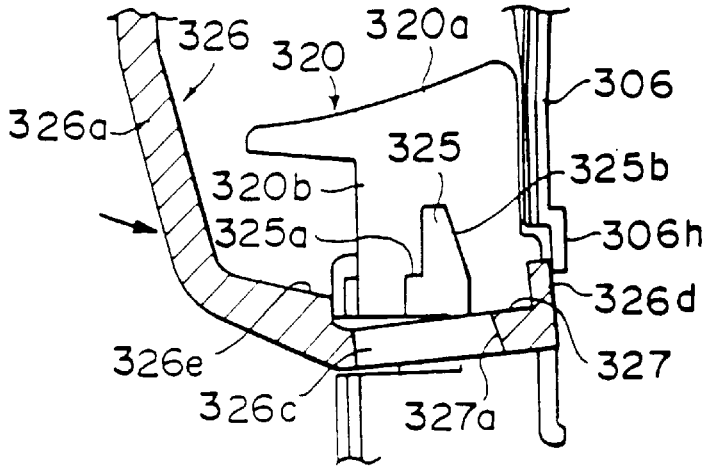
Figure 18C:
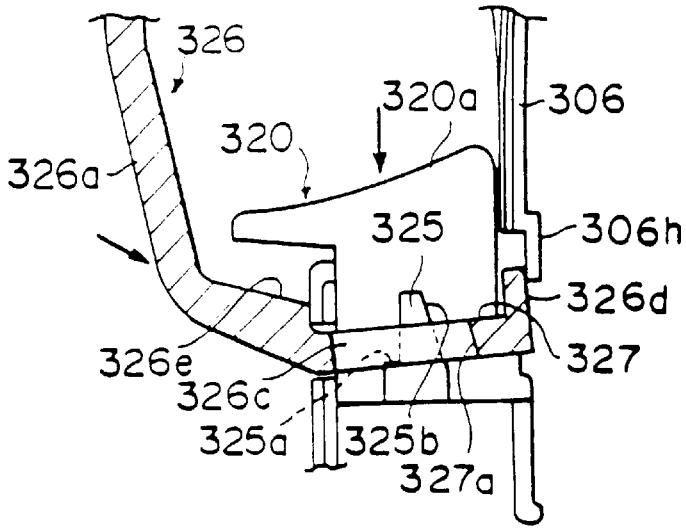

Engagement sections 327, 327, which project towards each other, are formed at the inner sides of the other end portions 326*c*, 326*c* and at the positions adjacent to the stoppers 326*d*, 326*d*. As illustrated in FIGS. 18A, 18B, and 18C, the end faces of the engagement sections 327, 327 are formed as approximately parallel slant surfaces 327*a*, 327*a* so as to stand facing the slant surfaces 325*b*, 325*b* of the projections 325, 325 of the operation member 320. The distance between the inner sides of the other end portions 326*c*, 326*c* corresponds to the width of the operation member 320, including the projections 325, 325. Therefore, the projections 325, 325 can pass through the space defined by the inner sides of the other end portions 326*c*, 326*c*. Also, the distance between the inner sides of the engagement sections 327, 327 corresponds to the width of the operation member 320, excluding the projections 325, 325. Therefore, the projections 325, 325 cannot pass between the inner sides of the engagement sections 327, 327. Thus the engagement sections 327, 327 can interfere with the projections 325, 325. A projection 326*e* is formed at the base portion of the frame body 326*a*, from which the other end portions 326*c*, 326*c* are branched. As in the stoppers 326*d*, 326*d*, when the protection frame 326 is deformed for the lock release, and the other end portions 326*c*, 326*c* are thereby pushed into the intermediate case housing 306, the projection 326*e* comes into contact with the front surface of the intermediate case housing 306 and thereby restricts the deformation of the protection frame 326.

The operation member 320 and the protection frame 326 have the relationship described above. Therefore, the projections 325, 325 and the engagement sections 327, 327 interfere with each other, and the lighting operation is thereby locked. Also, when the other end portions 326*c*, 326*c* of the protection frame 326 are pushed and the lock of the lighting operation is thereby released, it becomes possible for the operation member 320 to slide in order to carry out the lighting operation. When the operation member 320 returns to the original position and the lock releasing operation of the protection frame 326 is released, the engagement sections 327, 327 automatically return to the state of the locking of the lighting operation.

How the safety device in the lighting rod 301 operates will be described hereinbelow. First, as illustrated in FIGS. 14 and 15, when the lighting rod 301 is in the ordinary state (i.e., when it is not used), the protection frame 326 is allowed to stand, and the other end portions 326*c*, 326*c* of the protection frame 326 are projected from the intermediate case housing 306 and is thus located in the position for the locking. In this ordinary state, as illustrated in FIG. 18A, the engagement sections 327, 327 of the protection frame 326 are located at the positions, which interfere with the projections 325, 325 of the operation member 320. In this state, even if the pushing force is applied to the operation member 320, the operation member 320 cannot be pushed down due to the interference of the projections 325, 325 and the engagement sections 327, 327, and thus the lighting operation cannot be carried out. Therefore, even if persons, who do not know how to use the lighting rod 301 appropriately, operate the lighting rod 301, the gas is not lighted. Accordingly, careless lighting can be prevented.

When the lighting rod 301 is to be used, as illustrated in FIG. 17, the protection frame 326 is pushed and deformed such that the other end portions 326*c*, 326*c* of the protection frame 326 may enter into the intermediate case housing 306. While the lock releasing operation is being thus carried out, the lighting operation is carried out by pushing the operation member 320 down. As illustrated in FIG. 18B, when the other end portions 326*c*, 326*c* are thus pushed into the intermediate case housing 306, the engagement sections 327, 327 move inwardly from the positions, which interfere with the projections 325, 325 of the operation member 320. In this manner, the projections 325, 325 of the operation member 320 are set to the state of the lock release. Therefore, as illustrated in FIG. 18C, it becomes possible for the operation member 320 to be pushed down.

When the finger of the user is released from the operation member 320 in order to extinguish the fire, the operation member 320 is returned to the original position by the urging force of a spring, which is located in the piezo-electric unit 22. Also, when the lock releasing operation of the protection frame 326 is released, the other end portions 326*c*, 326*c* are moved to the projecting direction by the resilient restoring force of the protection frame 326. As a result, the engagement sections 327, 327 move to the positions, which interfere with the projections 325, 325. In this manner, the engagement sections 327, 327 automatically return to the state of the locking, in which the operation member 320 cannot be pushed down.

If the lock releasing operation of the protection frame 326 is released before the operation member 320 returns to the original position, the engagement sections 327, 327 of the protection frame 326 will move to the positions for the locking. However, in such cases, the slant surfaces 325*b*, 325*b* of the projections 325, 325 of the operation member 320 come into contact with the slant surfaces 327*a*, 327*a* of the engagement sections 327, 327. The projections 325, 325 of the operation member 320 pass along the slant surfaces 327*a*, 327*a* of the engagement sections 327, 327 by causing the engagement sections 327, 327 to move such that the protection frame 326 may be deformed. In this manner, the engagement sections 327, 327 automatically return to the state of the locking.

With the fifth embodiment, a metal spring is not used to obtain the force for restoring the protection frame 326 from the state of the lock release to the state of the locking. Therefore, the production cost can be kept low, the assembly work can be kept simple, and the working efficiency can be kept high. Also, because the entire protection frame 326 deforms resiliently with respect to the fixing section 326*b* taken as the base point, the amount of displacement operation during the lock releasing operation becomes large, and the operation can be carried out reliably. Further, it is easy to carry out the lock releasing operation. Furthermore, the dimensional accuracy required can be kept comparatively low, and therefore it becomes easy to produce the lighting rod 301.

When the protection frame 326 is being pushed and the lock release is being continued, even if the operation member 320 returns to the original position, the operation member 320 is not locked. Also, the lock releasing operation of the protection frame 326 is carried out with a finger of the user, which is different from the finger for pushing the operation member 320. Therefore, when the fuel gas is to be lighted again in cases where it has not been lighted by a single lighting operation of the operation member, the operation member 320 may be merely pushed down again, and it is not necessary for the lock releasing operation to be carried out each time the fuel gas is to be lighted. Accordingly, the fourth embodiment has good operability.

In the fifth embodiment, the force for restoring from the state of the lock release to the state of the locking is obtained by utilizing the resilient deformation of the protection frame 326. Alternatively, the other end portions 326*c*, 326*c* of the protection frame 326 may be located such that they can be displaced by taking the one end as the base point, and urging members for urging the other end portions 326*c*, 326*c* to the projecting direction may be located.

A sixth embodiment of the safety device in a lighting rod in accordance with the present invention will be described hereinbelow.

In this embodiment, the basic structures of the valve mechanism 8, the operation member 20 and the like of the lighting rod 401 are the same as those in the first embodiment. Accordingly in FIGS. 19 to 21, 22A, 22B, 23A and 23B, the elements analogous to those in the first embodiment are given the same reference numerals and will not be described here.

Figure 21:
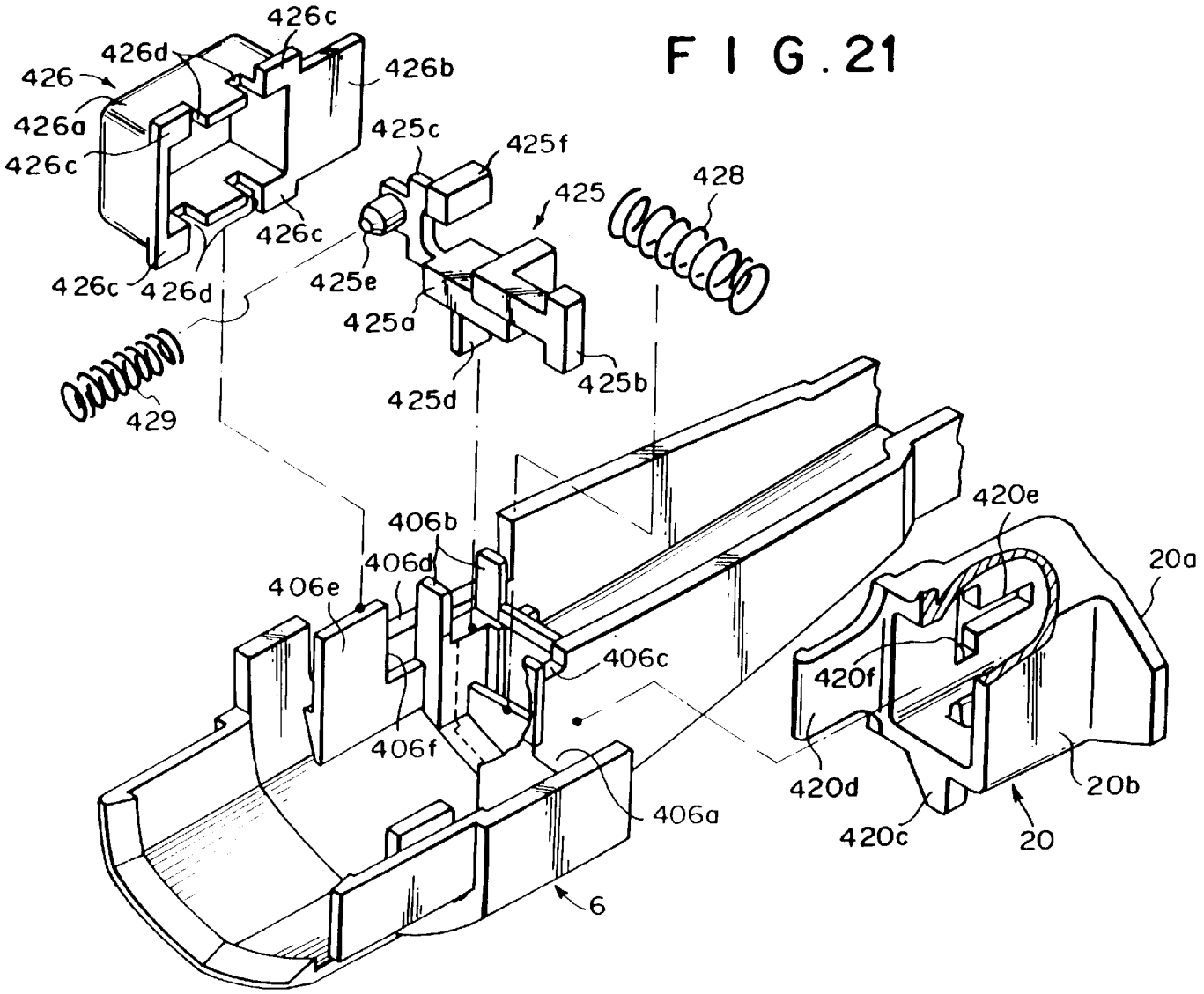
FIG. 21 is an exploded perspective view of the parts shown in FIG. 20, FIGS. 22A and 22B are views similar to FIG. 19 for illustrating the operation of the safety device of the sixth embodiment.

As shown in FIG. 21, the operation member 20 has a box-like section 20*b* which is fitted in an opening 406*a* of the intermediate case housing 6 to be slidable therein. A pair of protrusions 420*c* project outward from opposite sides of the box-like section 20*b*. The protrusions 420*c* abut against an inner surface of the intermediate case housing 6 to limit the position of the operation member 20 in which it is normally held. In side surface of the box-like section 20*b* of the operation member 20 between the operating section 20*a* and the projection 20*d*, which pushes the end of the rotatable lever 14 to rotate the rotatable lever 14, there is formed a vertical groove 420*e* extending along the path of up and down movement of the operation member 20. An engagement groove 42*f* is formed at the end of the vertical groove 420*e* to extend transversely to the vertical groove 420*e*.

Though not shown, the intermediate case housing 6 is provided with a protection frame similar to the protection frame 6*a* shown in FIG. 1.

Figure 19:
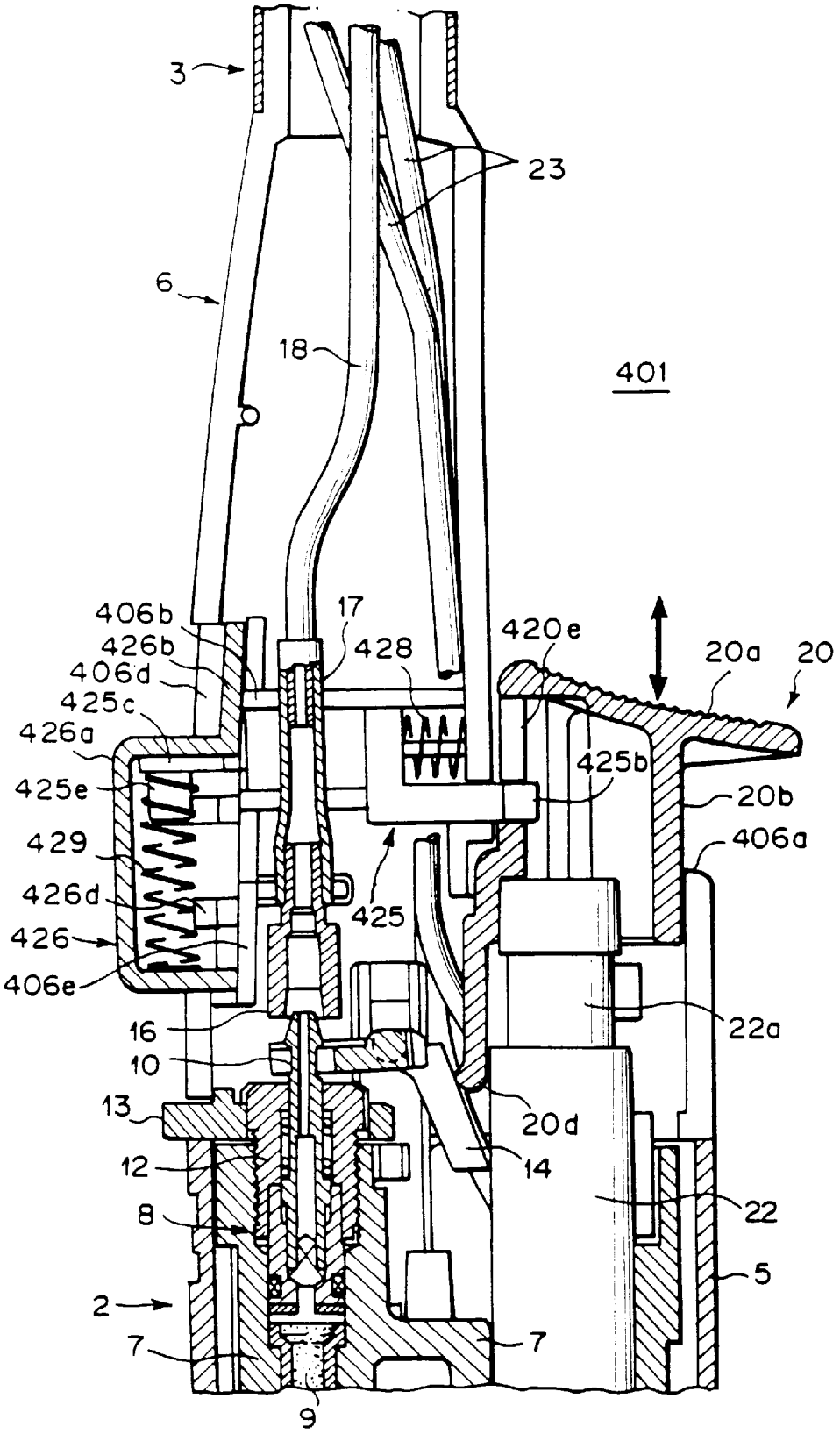
FIG. 19 is a vertical sectional side view showing the major part of a lighting rod, in which a sixth embodiment of the safety device in accordance with the present invention is employed.
Figure 20:
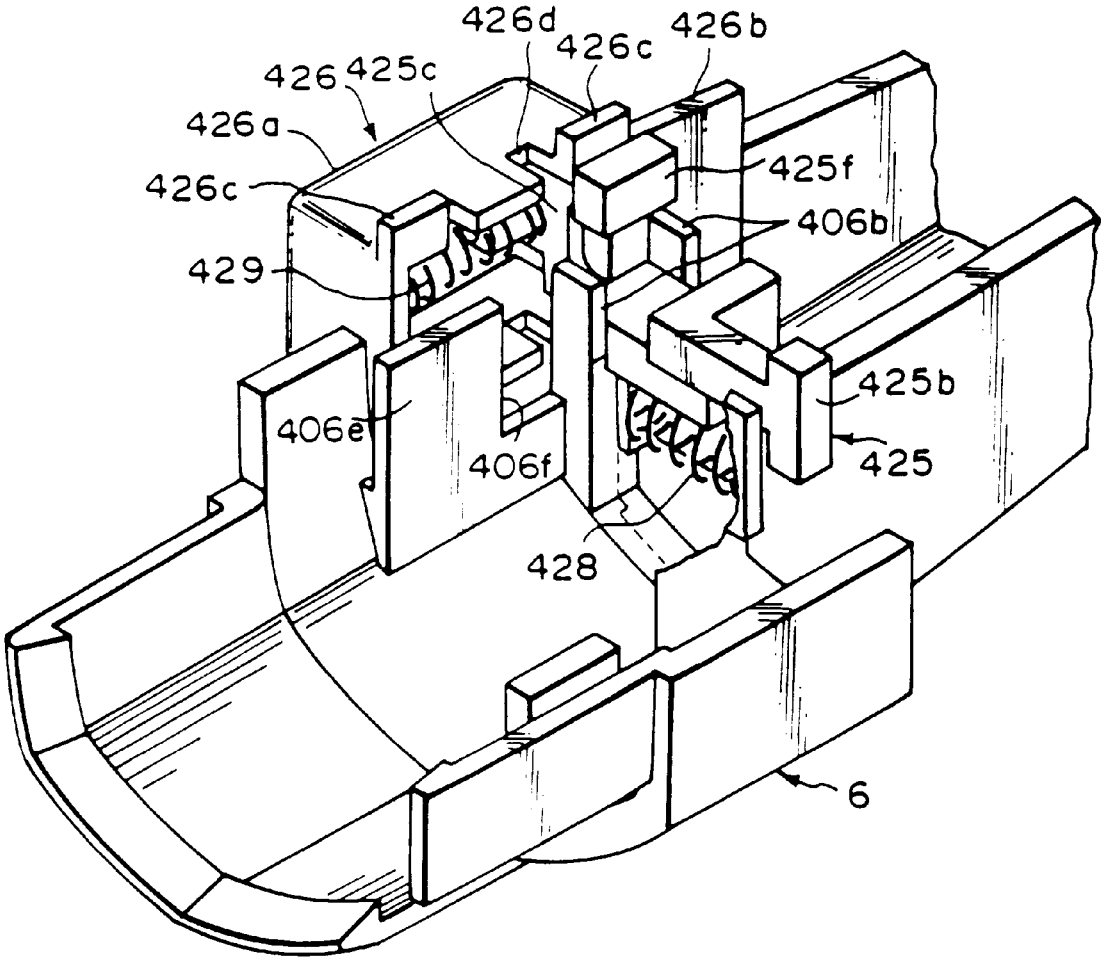
FIG. 20 is a perspective view showing the assembled states of the parts forming the safety device.

The lighting rod 401 mainly differs from the lighting rods described above in the structure of the safety device. That is, in this embodiment, the safety device comprises a locking member 425 for locking the lighting operation of the operation member 20 and an unlocking member 426 which releases the operation member 20. The unlocking member 426 is interlocked with the locking member 425 so that the locking member 425 is moved from its locking position to its lock release position to permit lighting operation of the operation member 20 when the unlocking member 426 is once slid in a direction (upward as seen in FIG. 19) opposite to the direction in which the operation member 20 is moved upon the lighting operation and then pushed rightward toward the main body 2 of the lighting rod 401.

The locking member 425 transversely extends through the intermediate case housing 6 to be slidable substantially in perpendicular to the longitudinal direction of the intermediate case housing 6 or the direction in which the operation member 20 is moved upon the lighting operation. The intermediate case housing 6 is further provided with first guide members 406*b* in the form of parallel plates.

As shown also in FIG. 21, the locking member 425 comprises a rod-like base portion 425*a* and a T-shaped engagement portion 425*b* formed on one end of the base portion 425*a*. A connecting portion 425*c* which extends into the unlocking member 426 is formed on the other end of the base portion 425*a*.

The engagement portion 425*b* of the locking member 425 can enter the engagement groove 420*f* of the operation member 20 through a passage 406*c* of the intermediate case housing 6 to interfere with the operation member 20. In the locking position shown in FIG. 19, the wall surface of the engagement groove 420*f* is brought into abutment against the engagement portion 425*b* upon depression of the operation member 20, thereby preventing depression of the operation member 20. When the locking member 425 is moved to the lock release position by the unlocking member 426, the engagement portion 425*b* is pushed into the operation member 20 beyond the engagement groove 420*f*, and the portion of the locking member 425 behind the engagement portion 425*b* which is thin is received in the engagement groove 420*f* in alignment with the vertical groove 420*e* so that the portion slides along the vertical groove 420*e* upon depression of the operation member 20, thereby permitting depression of the operation member 20.

A first spring support 425*d* like a plate for supporting one end of a first urging member (coiled spring) 428 projects from one side of the base portion 425*a* of the locking member 425. The other end of the first urging member 428 is supported by the inner surface of the intermediate case housing 6 so that the first urging member 428 is compressed between the first spring support 425*d* and the inner surface of the intermediate case housing 6, thereby urging the locking member 425 in the direction away from the operation member 20 toward the locking position.

A cylindrical second spring support 425*e* projects from the connecting portion 425*c* of the locking member 425 in parallel to the direction in which the operation member 20 is moved upon depression thereof. The second spring support 425*e* supports one end of a second surging member (coiled spring) 429 which urges the operation member 20 toward its normal position. An abutment portion 425*f* is formed on the connecting portion 425*f* on the side opposite to the base portion 425*a* and is substantially opposed to the base portion 425*a*.

The unlocking member 426 has a box-like operating portion 426*a* which opens inward and a plate-like extension 426*b* is formed on the inner side of the operating portion 426*a*. A collar portion 426*c* is formed on the open end of the operating portion 426*a* at each corner thereof. A pair of slits 426*d* are formed between the collar portions 426*c* on each longitudinal side of the open end of the operating portion 426*a*.

A sliding window 406*d* extends in parallel to the direction of movement of the operation member 20 in the part of the intermediate case housing 6 where the unlocking member 426 is positioned. A second guide member 406*e* in the form of a wall is formed on the inner side of the sliding window 406*d* in parallel to the sliding window 406*d*. The outer end faces of said first guide members 406*b* are disposed forward of the second guide member 406*e* substantially flush with the second guide member 406*e*. The collar portions 426*c* and the extension 426*b* are inserted between the portion defining the sliding window 406*d* and the second guide member 406*e*, whereby the unlocking member 426 is supported for sliding movement in parallel to the direction of movement of the operation member 20.

An insertion window 406*f* opens between the first and second guide members 406*b* and 406*e* of the intermediate case housing 6 so that the rear collar portions 426*c* can be inserted into the insertion window 406*f* when the unlocking member 426 is moved forward. A space into which the forward collar portions 426*c* and the extension 426*b* can be inserted is formed forward of the first guide members 406*b*. Further the slits 426*d* of the unlocking member 426 are formed so that the end portions of the first guide members 406*b* can be inserted into the slits 426*d* when the unlocking member 426 is slid forward. That is, the unlocking member 426 can be pushed inward when it is slid forward to a predetermined position but cannot be pushed inward in its normal position or in the course of movement to the predetermined position.

In the predetermined position, the inner end portion of the unlocking member 426 between the slits 426*d* is in alignment with the end faces of the base portion 425*a* and the abutment portion 425*f* of the locking member 425 so that when the unlocking member 426 is pushed inward, the inner end portion of the unlocking member 426 between the slits 426*d* is brought into abutment against the ends faces and the locking member 425 is moved along with the unlocking member 426.

The operation of the safety device of this embodiment will be described, hereinbelow. The unlocking member 426 is normally held in the position shown in FIGS. 19 and 20 by the second urging member 428. In this state, the locking member 425 is held in the locking position by the first urging member 428 where the engagement portion 425*b* of the locking member 425 is in the engagement groove 420*f* of the operation member 20. In this state, depression of the operation member 20 is prevented by the engagement of the engagement groove 420*f* and the engagement portion 425*b*, and accordingly lighting operation cannot be effected.

Figure 22B:
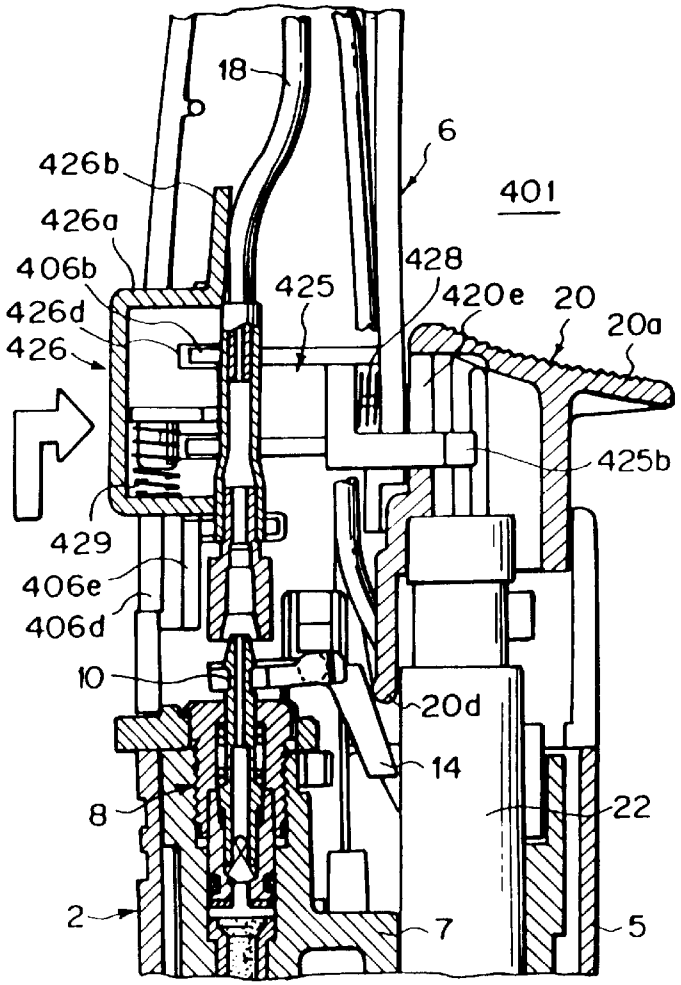
Figure 22A:
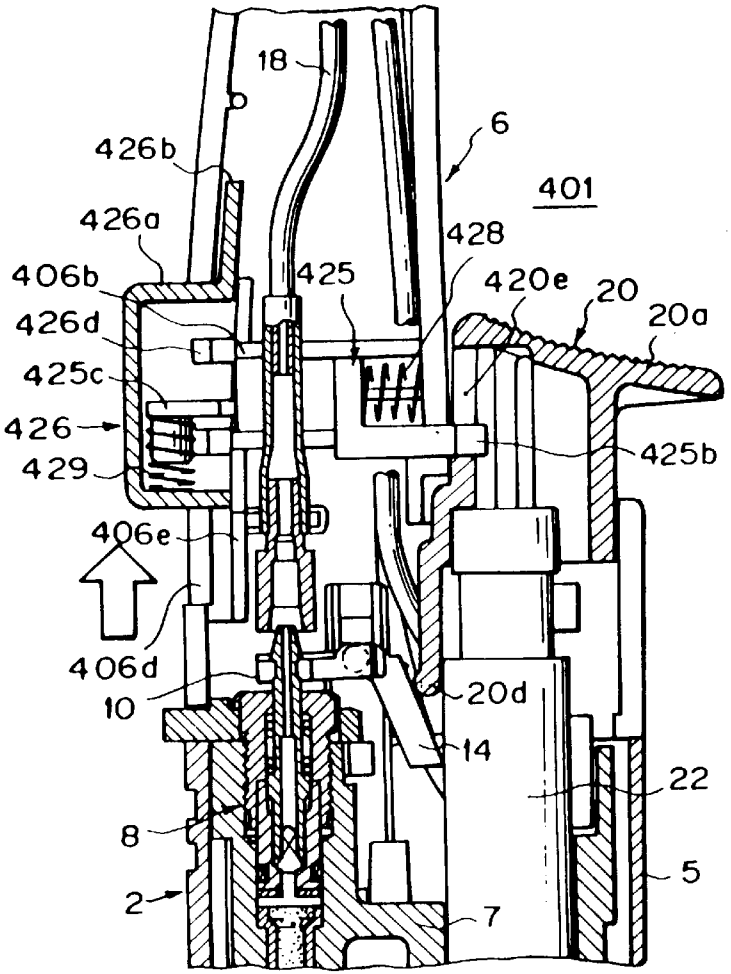
Figures 23A, 23B:
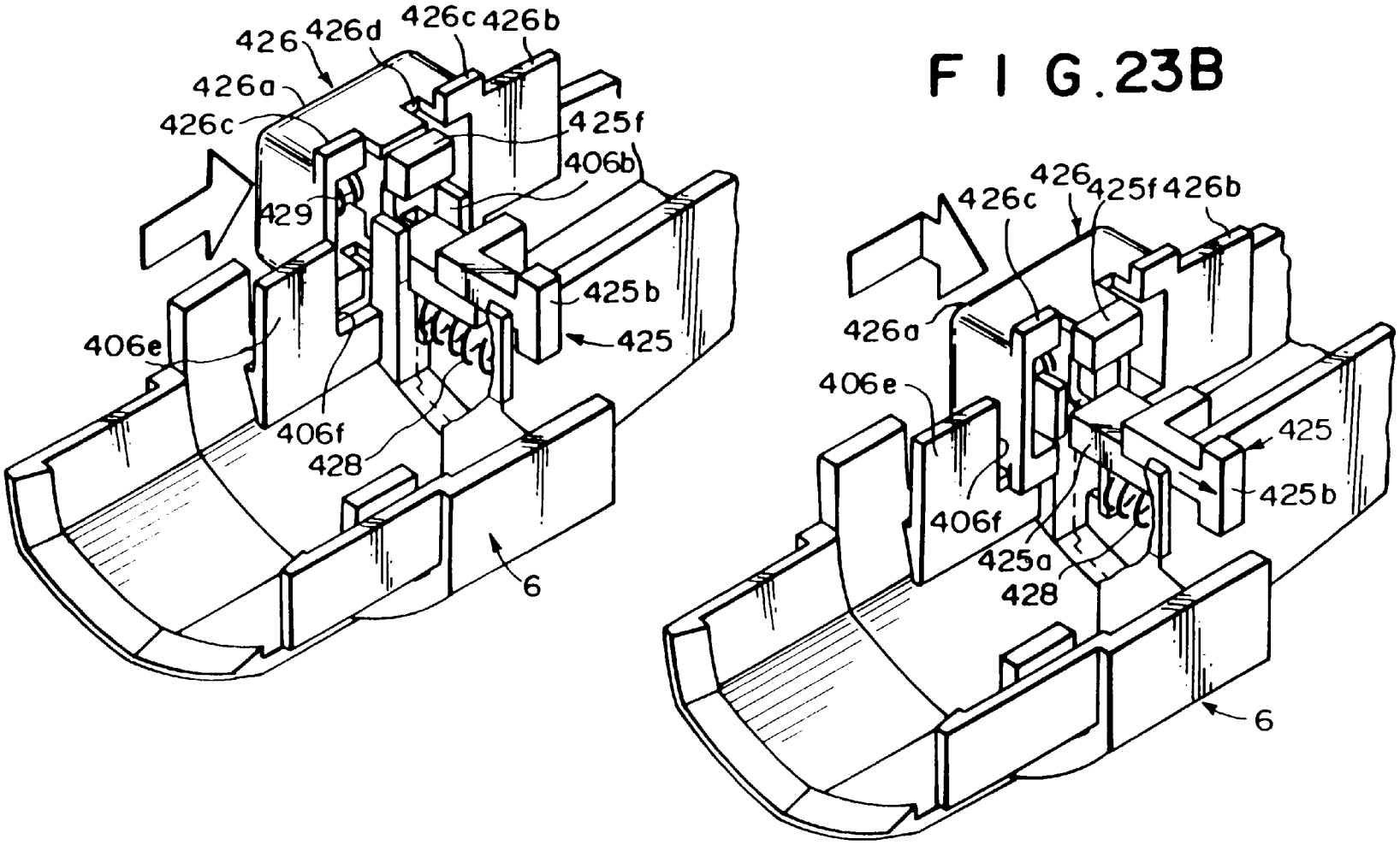
FIGS. 23A and 23B are views similar to FIG. 20 for illustrating the operation of the safety device of the sixth embodiment.

When the lighting rod 401 is to be used, the operating portion 426*a* of the operation member 20 is slid upward overcoming the force of the second urging member 429 to move the unlocking member 426 to said predetermined position where the slits 426*d* are in alignment with the first guide member 406*e* as shown in FIGS. 22A and 23A. Then the unlocking member 426 is pushed toward the operation member 20 as shown in FIGS. 22B and 23B. When the unlocking member 426 is pushed toward the operation member 20, the locking member 425 is moved from the locking position to the lock release position pushed by the unlocking member 426.

Then with the unlocking member 426 kept pushed, the operation member 20 is depressed. That is, since the engagement portion 425*b* of the locking member 425 has been disengaged from the engagement groove 420*f* of the operation member 20, the operation member 20 can be depressed for the lighting operation. When the operation member 20 is pushed down for the lighting operation, the rotatable lever 14 pulls out the nozzle member 10 and opens the gas flow path in the valve mechanism 8. Therefore, the gas is supplied through the gas pipe 18 to the jetting nozzle. Also, as the operation member 20 is operated in this manner, the piezo-electric unit 22 is caused to generate the discharge voltage (an alternating voltage). The discharge voltage is applied across the electrical discharge electrode, which is located at the extension 3, and the jetting nozzle, and the jetted gas is lighted by the discharge voltage.

So long as the unlocking member 426 is kept pushed, the lighting operation of the operation member 20 can be repeatedly effected.

When the operation member 20 and the unlocking member 426 are released, the operation member 20 is returned to the normal position under the force of the spring in the piezo-electric unit 22. When the engagement groove 420*f* of the operation member 20 comes to be aligned with the engagement portion 425*b* of the unlocking member 426 as a result of this movement of the operation member 20, the locking member 425 is moved leftward under the force of the first urging member 428 to bring the engagement portion 425*b* into engagement with the engagement groove 420*f* of the operation member 20. Thus the locking member 425 is automatically returned to the locking position.

In response to return of the locking member 425 to the locking position, the unlocking member 426 is pushed outward, and when the slits 426*d* of the unlocking member 426 are disengaged from the first guide members 406*b*, the unlocking member 426 is slid to the position where it is normally held under the force of the second urging member 429. Thus also the unlocking member 426 is automatically returned to the normal position.

Though, in the sixth embodiment described above, the unlocking member 426 is disposed on the opposite side of the operation member 20, the unlocking member 426 may be disposed on a side of the intermediate case housing 6 adjacent to the side on which the operation member 20 is disposed. In this case, for example, the locking member 425 is bent and is arranged so that the engagement portion of the locking member 425 is disengaged from the engagement groove of the operation member 20 by bringing the engagement portion into alignment with the vertical groove 420*e* in response to pushing the unlocking member 426 toward the intermediate case housing 6. Such an arrangement may be variously modified.

Figure 24B:
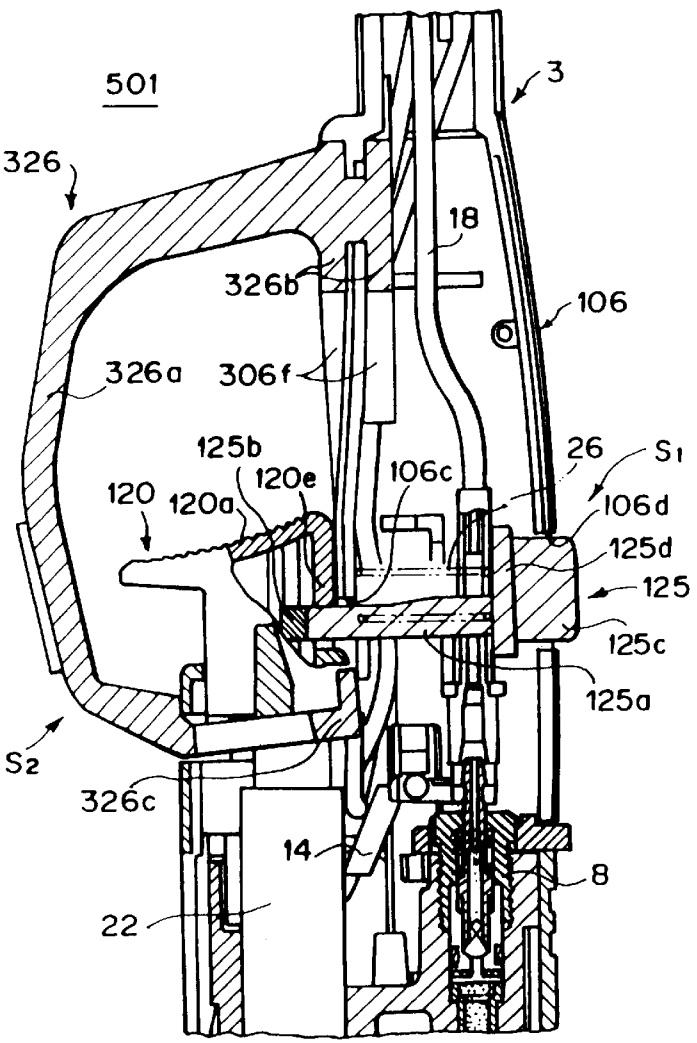
FIG. 24B is a fragmentary cross-sectional view showing a lighting rod in the unlocked state provided with a safety device in accordance with a seventh embodiment of the present invention.
Figure 24A:
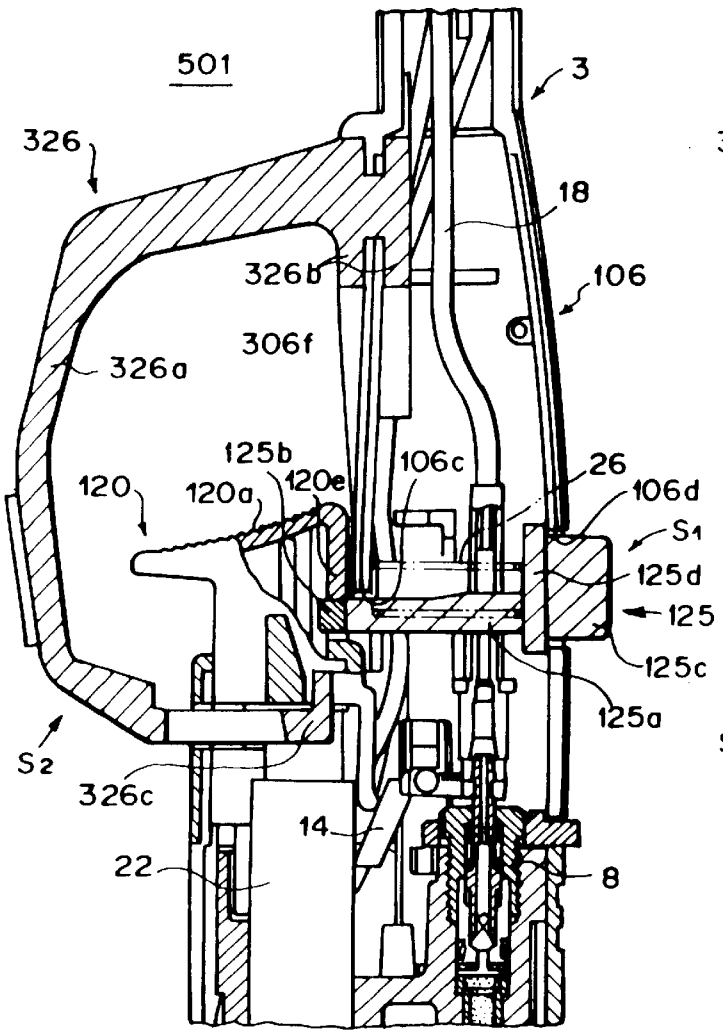
FIG. 24A is a fragmentary cross-sectional view showing a lighting rod in the locked state provided with a safety device in accordance with a seventh embodiment of the present invention.

A seventh embodiment of the present invention will be described with reference to FIGS. 24A and 24B, hereinbelow. The lighting rod 501 shown in FIGS. 24A and 24B is provided with a safety device in accordance with the seventh embodiment of the present invention. The safety device of this embodiment comprises first and second locking mechanisms S1 and S2 and the lighting operation cannot be effected unless both the first and second locking mechanisms are unlocked.

The first locking mechanism S1 is basically the same in structure as the safety device of the third embodiment shown in FIG. 5 and the second locking mechanism S2 is basically the same in structure as the safety device of the fifth embodiment shown in FIG. 14. Accordingly the elements of the first locking mechanism S2 analogous to those of the safety device of the third embodiment are given the same reference numerals and will not described in detail here, and similarly the elements of the second locking mechanism S2 analogous to those of the safety device of the fifth embodiment are given the same reference numerals and will not described in detail here.

The first locking mechanism S1 comprises a locking member 125 and an urging member 26.

The locking member 125 comprises a rod-like shaft 125*a*, an engagement section 125*b*, which projects in the form of a hook from two side surfaces of an end of the shaft 125*a* (see also FIG. 7), and a lock releasing section 125*c*, which has a cylindrical button-like shape and is located at the other end of the shaft 125*a*. The portion of the shaft 125*a*, which is adjacent to the engagement section 125*b*, and the lock releasing section 125*c* can project respectively from the intermediate case housing 106 through windows 106*c* and 106*d*, which are formed in the wall of the intermediate case housing 106. Also, a portion of the locking member 125, which is located between the lock releasing section 125*c* and the shaft 125*a*, continues into a spring receiver 125*d*, which supports an end of the urging member (a coiled spring) 26.

The other end of the urging member 26 is in contact with the opposing inner wall of the intermediate case housing 106. In this manner, the urging member 26 is located in the contracted state between the spring receiver 125*d* of the locking member 125 and the opposing inner wall of the intermediate case housing 106. The locking member 125 is urged by the urging force of the urging member 26 towards the direction such that the lock releasing section 125*c* may be projected from the intermediate case housing 106 to the exterior, i.e. towards the locking direction.

The engagement section 125*b* of the locking member 125 can be inserted into the window 106*c* and an engagement groove 120*f* of the operation member 120 and can thereby interfere with the operation member 120. When the engagement section 125*b* is engaged with the engagement groove 120*f* of the operation member 120 as shown in FIG. 24A, even if the pushing force for pushing the operation member 120 down for the lighting operation is applied to the operation member 120, a box-like section 120*b* of the operation member 120 comes into contact with the upper surface of the engagement section 125*b*, and the operation member 120 cannot be pushed down. The lock releasing section 125*c* can project through the window 106*d* from the wall of the intermediate case housing 106, which is located on the side opposite to the operating section 120*a* of the operation member 120. When the lock releasing section 125*c* is pushed into the intermediate case housing 106, the locking member 125 moves to the direction, which immerses against the urging force of the urging member 26.

When the lock releasing section 125*c* is immersed, the engagement section 125*b*, which is located on the side opposite to the lock releasing section 125*c*, moves from the engagement groove 120*f* into the operation member 120. The shaft 125*a* of the locking member 125 can slide along the vertical groove 120*e* of the operation member 120.

The operation member 120 and the locking member 125 have the relationship described above. Therefore, when the lock releasing section 125*c* of the locking member 125 and the operating section 120*a* of the operation member 120 are simultaneously operated, and the lock of the lighting operation is thereby released, it becomes possible for the operation member 120 to slide in order to carry out the lighting operation (so long as the second locking mechanism S2 is unlocked as will be described later). As the operation member 120 returns to the original position, the locking member 125 automatically returns to the state of the locking of the lighting operation.

The second locking mechanism S2 comprises a protection frame 326 and projections 325, 325 (see also FIG. 15) of the operation member 120 (320 in FIG. 15).

Each of the projections 325, 325 of the operation member 120 is formed such that the top end closer to the operating section 120*a* is narrow, and the bottom end remoter from the operating section 120*a* is wide. A step-like portion 325*a* continue from one of the two side surfaces of the bottom end, and the portion of the other side surface, which portion is adjacent to the top end, is formed as a slant surface 325*b*. The top ends of the projections 325, 325 can be inserted into cutaway portions 306*d*, 306*d* (one of them is shown in FIG. 16), which are formed in a wall 306*c* of the intermediate case housing 106 (306 in FIGS. 15, 16 and 17). The step-like portions 325*a*, 325*a* of the projections 325, 325 come into contact with the lower surface of the wall 306*c*, and the position, to which the operation member 120 projects, is thereby restricted.

The protection frame 326 comprises a frame body 326*a*, which has a bent shape, and a fixing section 326*b*, which is formed at one end of the frame body 326*a*. The fixing section 326*b* is inserted into an engagement window 306*e* (FIG. 16) of the intermediate case housing 106. The two plates of the fixing section 326*b* sandwich the wall of the intermediate case housing 106, and are thereby fixed to the intermediate case housing 106. Also, fixing projections 306*f* are formed on the surfaces of the intermediate case housing 106 at positions above and below the engagement window 306*e*. The upper and lower ends of the two plates of the fixing section 326*b* of the protection frame 326 come into contact with the fixing projections 306*f*, and the fixing section 326*b* of the protection frame 326 is thereby fixed firmly and reliably to the intermediate case housing 106. The fixing projection 306*f*, which is located close to the operating section 120*a* of the operation member 120, is tapered such that the space defined by the protection frame 326 may be formed by a smooth continuous surface.

The protection frame 326 is supported only at the fixing section 326*b*. The other end portions 326*c*, 326*c* of the frame body 326*a* are inserted into the intermediate case housing 106 such that they can move due to deformation of the protection frame 326. When the protection frame 326 is deformed for the lock release such that the other end portions 326*c*, 326*c* may enter into the intermediate case housing 106, the other end portions 326*c*, 326*c* moves in the direction intersecting approximately perpendicularly to the direction, along which the operation member 120 slides, due to the resilient deformation of the protection frame 326 with the fixing section 326*b* being taken as a base end. In this state, the other end portions 326*c*, 326*c* have the resilient restoring force due to the deformation.

The other end portions 326*c*, 326*c* of the protection frame 326 are spread to opposite sides and extend inwardly along the sides of the operation member 120. The operation member 120 is interleaved between the two other end portions 326*c*, 326*c*. Stoppers 326*d*, 326*d* (FIG. 15) are formed at the ends of the other end portions 326*c*, 326*c*. The stoppers 326*d*, 326*d* come into contact with the projections 325, 325 of the operation member 120 from the inward sides of the projections 325, 325, and the positions, to which the other end portions 326*c*, 326*c* project outwardly, are thereby restricted. Also, when the protection frame 326 is deformed for the lock release, and the other end portions 326*c*, 326*c* are thereby pushed into the intermediate case housing 106, the stoppers 326*d*, 326*d* come into contact with an opening edge 306*h* (FIG. 16) of the intermediate case housing 106, and the positions, to which the other end portions 326*c*, 326*c* can be pushed inwardly, are thereby restricted.

Engagement sections 327, 327 (FIG. 15), which project towards each other, are formed at the inner sides of the other end portions 326*c*, 326*c* and at the positions adjacent to the stoppers 326*d*, 326*d*. The end faces of the engagement sections 327, 327 are formed as approximately parallel slant surfaces 327*a*, 327*a* so as to stand facing the slant surfaces 325*b*, 325*b* of the projections 325, 325 of the operation member 120. The distance between the inner sides of the other end portions 326*c*, 326*c* corresponds to the width of the operation member 120, including the projections 325, 325. Therefore, the projections 325, 325 can pass through the space defined by the inner sides of the other end portions 326*c*, 326*c*. Also, the distance between the inner sides of the engagement sections 327, 327 corresponds to the width of the operation member 120, excluding the projections 325, 325. Therefore, the projections 325, 325 cannot pass between the inner sides of the engagement sections 327, 327. Thus the engagement sections 327, 327 can interfere with the projections 325, 325. A projection 326*e* is formed at the base portion of the frame body 326*a*, from which the other end portions 326*c*, 326*c* are branched. As in the stoppers 326*d*, 326*d*, when the protection frame 326 is deformed for the lock release, and the other end portions 326*c*, 326*c* are thereby pushed into the intermediate case housing 106, the projection 326*e* comes into contact with the front surface of the intermediate case housing 106 and thereby restricts the deformation of the protection frame 326.

The operation member 120 and the protection frame 326 have the relationship described above. Therefore, the projections 325, 325 and the engagement sections 327, 327 interfere with each other, and the lighting operation is thereby locked. Also, when the other end portions 326*c*, 326*c* of the protection frame 326 are pushed and the lock of the lighting operation is thereby released, it becomes possible for the operation member 120 to slide in order to carry out the lighting operation (so long as the first locking mechanism S1 described is unlocked). When the operation member 120 returns to the original position and the lock releasing operation of the protection frame 326 is released, the engagement sections 327, 327 automatically return to the state of the locking of the lighting operation.

Thus in the safety device of this embodiment having the first and second locking mechanisms S1 and S2, the operation member 120 cannot be depressed for the lighting operation unless the first and second locking mechanisms S1 and S2 are both unlocked as shown in FIG. 24B and accordingly the safety device of this embodiment provides more safety to the lighting rod 501.

What is claimed is:

1. A safety device in a lighting rod, which lighting rod is provided with a rod-like top end portion and a main body, the rod-like top end portion being provided with a jetting nozzle for jetting out a gas, the main body being provided with:

i) a gas tank, ii) a valve mechanism for opening and closing a path, through which the gas is supplied from the gas tank to the jetting nozzle, iii) a piezo-electric unit for generating a discharge voltage for lighting the gas, iv) an operation member, which is capable of sliding, which has an operating section, and which drives the valve mechanism and the piezo-electric unit in order to carry out a lighting operation, the operating section of the operation member being exposed to the exterior of the main body, and v) a guide frame, which is located so as to surround the operating section of the operation member, the safety device comprising:

a) a locking member, which interferes with the operation member and thereby locks the lighting operation of the operation member, said locking member being associated with the guide frame such that said locking member can rotate, and b) an urging member, which urges said locking member to a locking direction, said locking member projecting to the side outward from said guide frame when said locking member is in the state of the locking, said locking member being provided with a lock releasing section, which is capable of being operated in order to move said locking member in a direction, that acts against the urging force of said urging member, and in order to thereby release said interference of said locking member with the operation member, wherein the lock of the lighting operation is released by operating said lock releasing section of said locking member, the lighting operation is carried out in this state by operating the operating section of the operation member, and said locking member automatically returns to the state of the locking when the operation member returns to its original position in the state in which the lock releasing operation has been released.

2. A device as defined in claim 1 wherein said locking member is provided with a projection, which interferes with a portion of the operation member when said locking member is located at the position for the locking, and the operation member is provided with a groove, through which said projection of said locking member is inserted when said locking member has been rotated to the position for the lock release.

3. A device as defined in claim 2 wherein said groove of the operation member is provided with an engagement section, which comes into contact with said projection of said locking member and restricts the rotation of said locking member to the state of the locking when said projection of said locking member is being inserted through said groove of the operation member.

4. A safety device in a lighting rod, which lighting rod is provided with a rod-like top end portion and a main body, the rod-like top end portion being provided with a jetting nozzle for jetting out a gas, the main body being provided with:

i) a gas tank, ii) a valve mechanism for opening and closing a path, through which the gas is supplied from the gas tank to the jetting nozzle, iii) a piezo-electric unit for generating a discharge voltage for lighting the gas, and iv) an operation member, which is capable of sliding, which has an operating section, and which drives the valve mechanism and the piezo-electric unit in order to carry out a lighting operation, the operating section of the operation member being exposed to the exterior of the main body, the safety device comprising first and second locking mechanisms, each comprising a locking member which is movable between a locking position where it interferes with the operation member and thereby locks the lighting operation of the operation member and a lock release position where it releases the operation member to permit the lighting operation of the operation member, and an unlocking member which is exposed to the exterior of the main body and is operated to move the locking member from the locking position to the unlocking position, the unlocking members of the first and second locking mechanisms being operated separately from each other, wherein the lock of the lighting operation is released by simultaneously operating both the unlocking members of the first and second locking mechanisms, and the lighting operation is carried out in this state by operating the operating section of the operation member.

5. A safety device as defined in claim 4 in which the main body of the lighting rod is further provided with a protection frame, which is located so as to surround the operating section of the operation member, the first locking mechanism of the safety device comprises a) a locking member, which interferes with the operation member and thereby locks the lighting operation of the operation member, said locking member being capable of moving in a direction, that intersects with the direction along which the operation member moves, and b) an urging member, which urges said locking member to the locking position, and c) an unlocking member which is capable of being operated in order to move said locking member in a direction, that acts against the urging force of said urging member, said unlocking member being projected to the exterior of the main body on the side opposite to the operation member, said locking member automatically returned to the locking position as the operation member returns to its original position, and the second locking mechanism is constituted of the protection frame of the main body of the lighting rod, the protection frame having one end, which serves as a base point, and the other end capable of undergoing restoration displacement, which the other end extends to a side of the operation member and can move, said the other end being provided with an engagement section, which interferes with a portion of the operation member and locks the lighting operation of the operation member when said engagement section is in the state of the locking during the nonoperating condition of the operation member, said engagement section being moved to release the interference with the operation member in accordance with a lock releasing operation of the protection frame, and said engagement section automatically returns to the state of the locking in accordance with a returning movement of the operation member to its original position and a restoration movement of the protection frame.

6. A safety device in a lighting rod with which a fire is lighted comprising actuating means for lighting the lighting rod and automatically returnable locking means for releasably locking the actuating means arranged to permit operation of the actuating means when released and to automatically lock the actuating means following actuation.

* * * * *